US007363687B2

(12) United States Patent
Kraus et al.

(10) Patent No.: US 7,363,687 B2
(45) Date of Patent: Apr. 29, 2008

(54) SNAPPING AND HINGING ARRANGEMENTS, WATCHES AND ASSOCIATED METHODS

(75) Inventors: Stephanie Kraus, Glendale, CA (US); Chris Heatherly, Pasadena, CA (US); Randal Ouye, La Crescenta, CA (US); Julie Nishioka, Glendale, CA (US); John Holland, San Francisco, CA (US); Jeffrey Sand, San Francisco, CA (US)

(73) Assignee: Disney Enterprises, Inc., Burbank, CA (US)

( * ) Notice: Subject to any disclaimer, the term of this patent is extended or adjusted under 35 U.S.C. 154(b) by 213 days.

(21) Appl. No.: 11/040,752

(22) Filed: Jan. 21, 2005

(65) Prior Publication Data

US 2005/0128882 A1 Jun. 16, 2005

Related U.S. Application Data

(62) Division of application No. 10/753,737, filed on Jan. 7, 2004, now Pat. No. 7,146,731.

(60) Provisional application No. 60/516,661, filed on Oct. 31, 2003, provisional application No. 60/438,755, filed on Jan. 7, 2003.

(51) Int. Cl.
*A44B 21/00* (2006.01)

(52) U.S. Cl. ..... 24/303; 368/282

(58) Field of Classification Search ..... None
See application file for complete search history.

(56) References Cited

U.S. PATENT DOCUMENTS

| | | | | |
|---|---|---|---|---|
| 574,904 | A * | 1/1897 | Holmes | 24/595.1 |
| D65,621 | S | 9/1924 | Strasser | |
| 2,134,242 | A * | 10/1938 | Wade | 47/47 |
| 2,637,887 | A | 5/1953 | Goodman et al. | |
| 2,654,929 | A | 10/1953 | Feibelman | |
| 2,870,502 | A * | 1/1959 | Sasse | 24/17 R |
| 3,102,314 | A * | 9/1963 | Alderfer | 24/303 |
| 3,502,396 | A * | 3/1970 | Greenberg et al. | 351/157 |
| 4,332,020 | A | 5/1982 | Leopold | |
| 4,399,595 | A * | 8/1983 | Yoon et al. | 24/303 |
| 4,571,199 | A | 2/1986 | Murakami | |
| D285,288 | S | 8/1986 | Chau | |
| D303,504 | S | 9/1989 | Hysek | |

(Continued)

FOREIGN PATENT DOCUMENTS

| | | |
|---|---|---|
| EP | 0233309 | 8/1987 |

OTHER PUBLICATIONS

Website (http://www.greatmerchants.com/WatchBuddyTimepieces.ivnu), Print date Jan. 5, 2006, 1 Page.

*Primary Examiner*—Jack W. Lavinder
(74) *Attorney, Agent, or Firm*—Greenberg Traurig, LLP

(57) ABSTRACT

A magnet assembly connectable to a metal assembly in an engaging fashion, a metal assembly connectable with the magnet assembly in an engaging fashion and a snapping mechanism comprising the magnet assembly and the metal assembly are disclosed, to be used with a strap and a watch case. A leaf spring element and a base element to be used with a watch case are also disclosed, together with manufacturing processes and a system and method to teach the concept of time.

6 Claims, 23 Drawing Sheets

U.S. PATENT DOCUMENTS 4,897,826 A * 1/1990 Rigberg et al. ..... 368/282
4,941,236 A * 7/1990 Sherman et al. ..... 24/303
D325,877 S 5/1992 Fong
D332,408 S 1/1993 Chodat et al.
D349,864 S 8/1994 Dunlap et al.
D356,269 S 3/1995 Milovanovic
D379,940 S 6/1997 Riley
5,701,640 A 12/1997 Locher
5,868,369 A * 2/1999 Montgomery ..... 248/214
D410,406 S 6/1999 Iwamoto
D428,353 S 7/2000 Duncan
D432,433 S 10/2000 Bruni
6,170,131 B1 * 1/2001 Shin ..... 24/303
D445,698 S 7/2001 Bruni
D454,801 S 3/2002 Moy
6,598,271 B2 7/2003 Nire
D486,404 S 2/2004 Shriqui
6,779,917 B1 8/2004 Chappuis
D507,498 S 7/2005 Hung
6,991,364 B2 1/2006 Yang
7,030,823 B2 * 4/2006 Apotheloz et al. ..... 343/718

* cited by examiner

FIG. 9
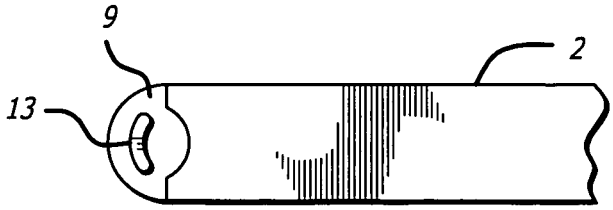
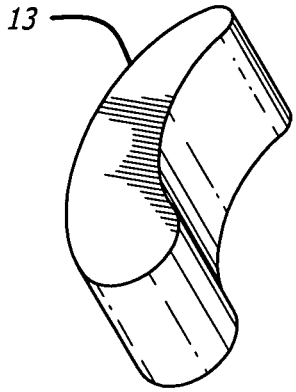
FIG. 10
FIG. 11
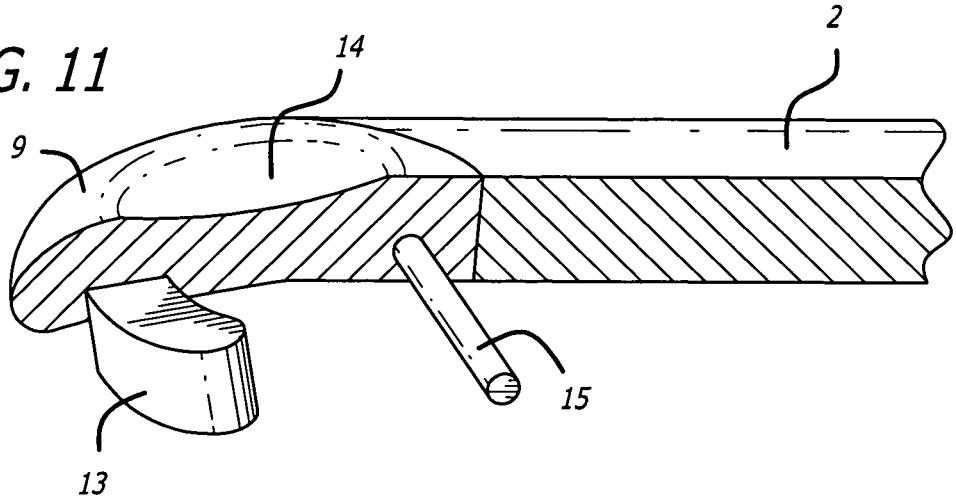
FIG. 12
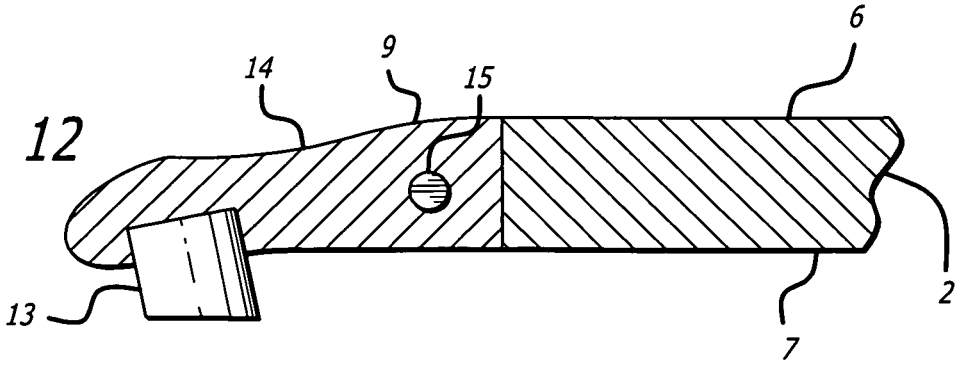

FIG. 13
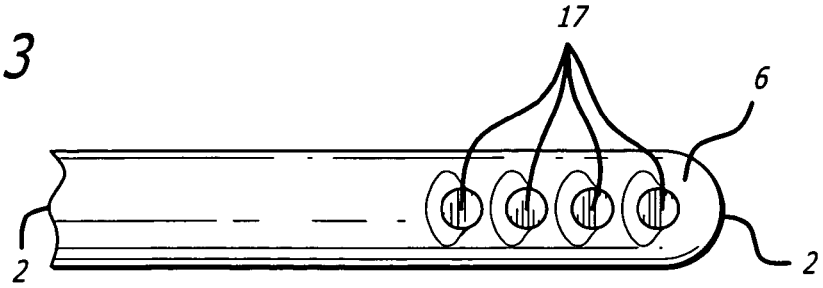
FIG. 14
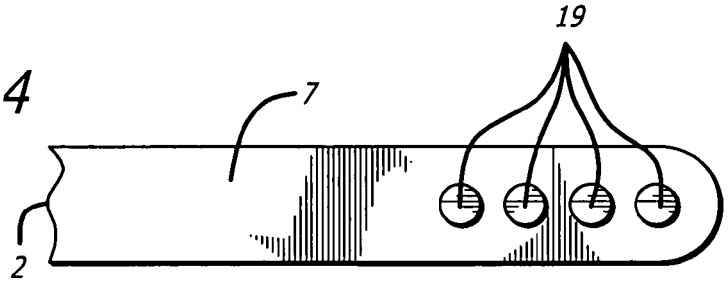
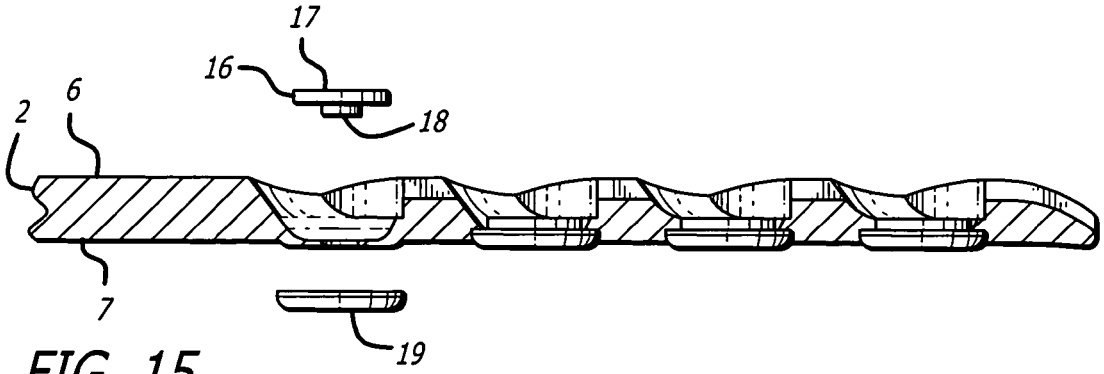
FIG. 15
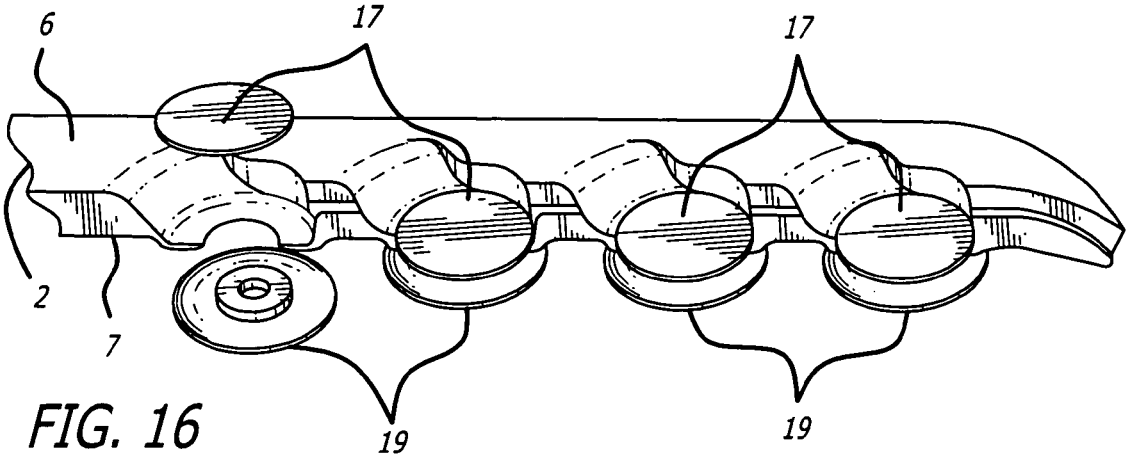
FIG. 16

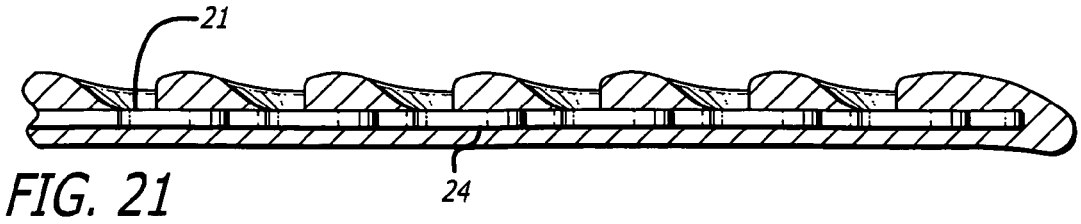
FIG. 21
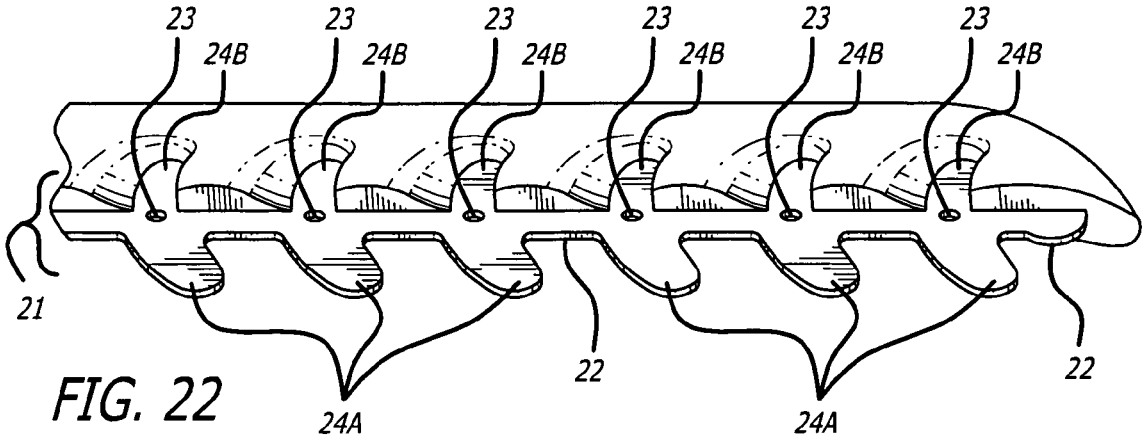
FIG. 22
FIG. 25
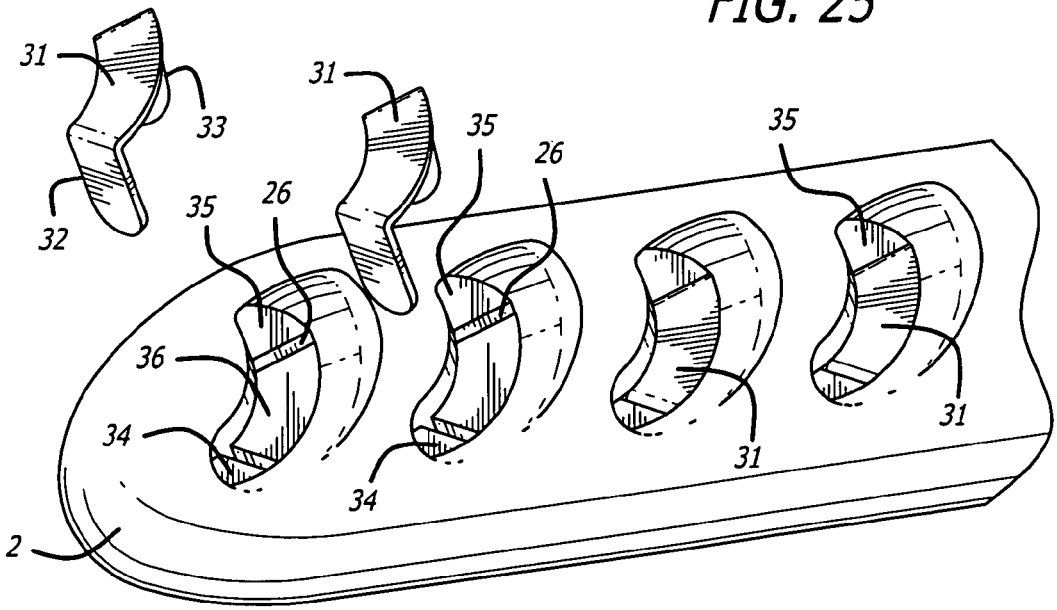

FIG. 37
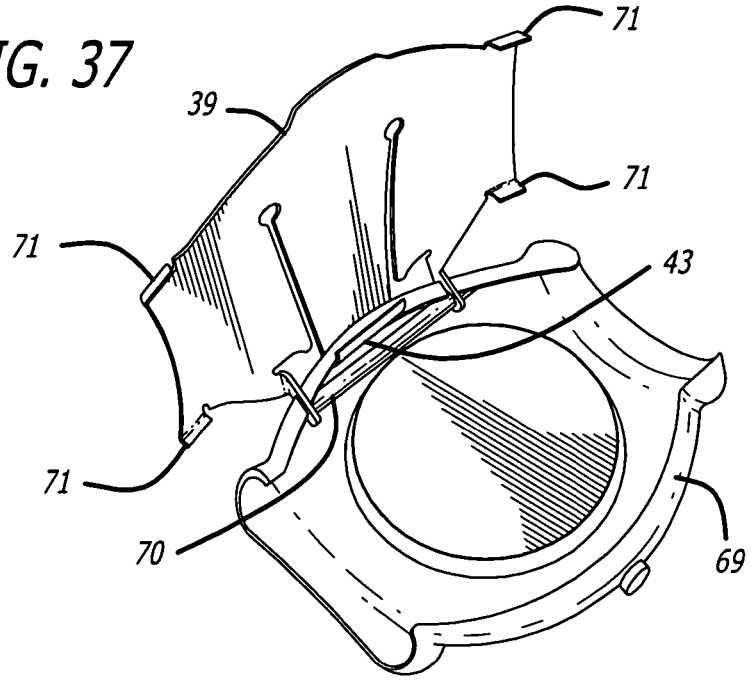
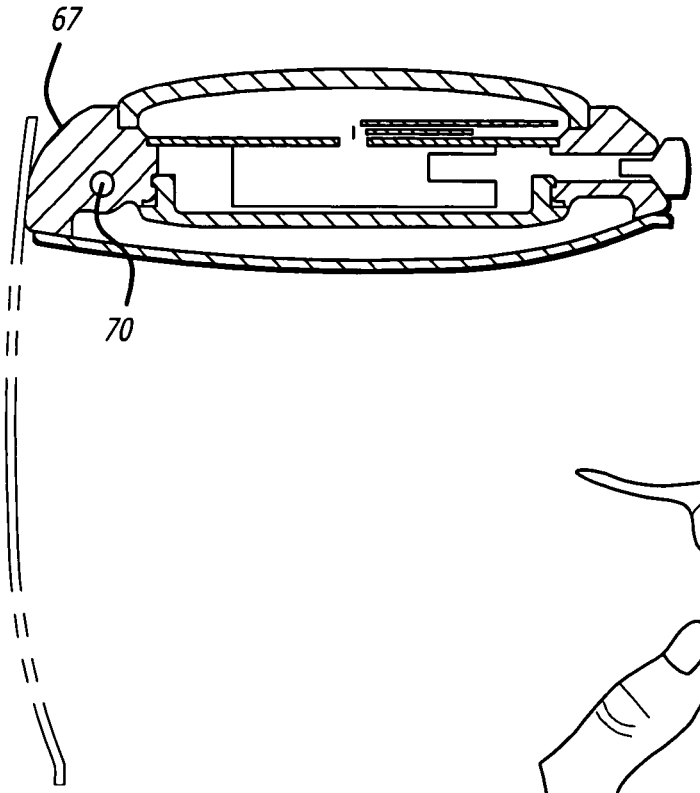
FIG. 38
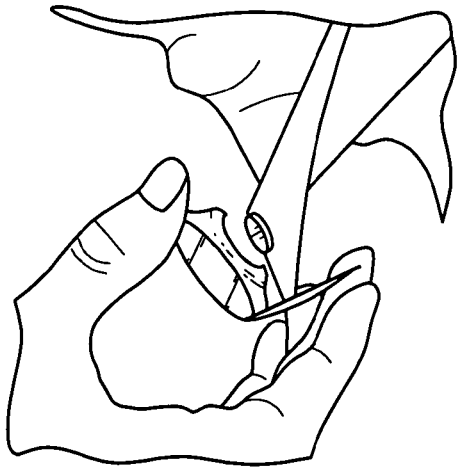
FIG. 39

FIG. 41
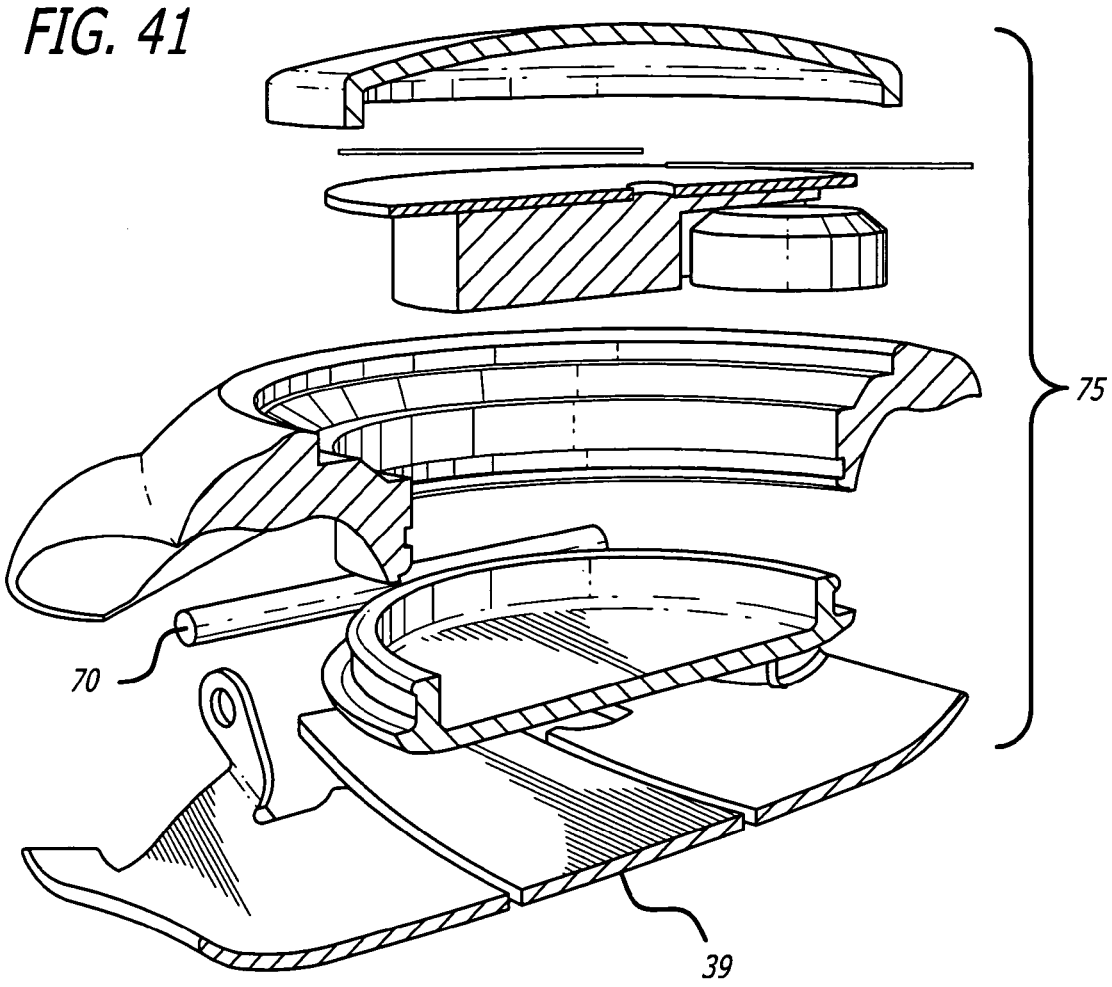
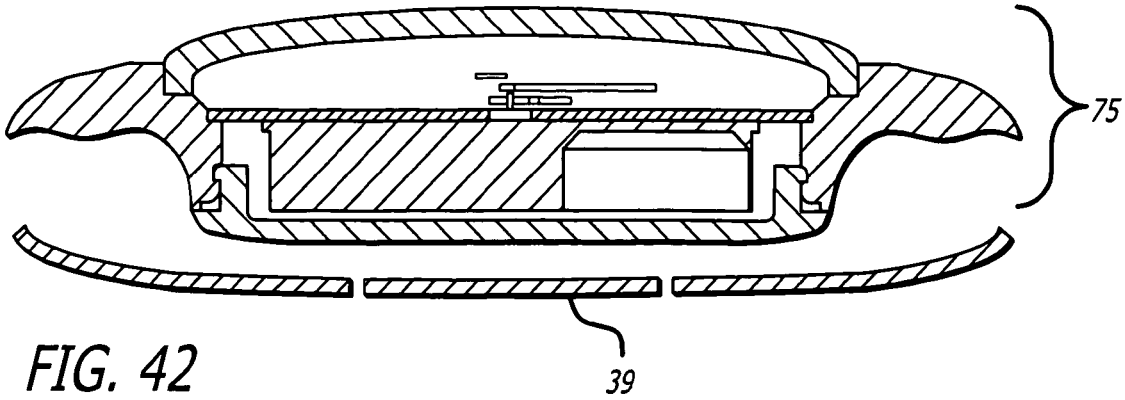
FIG. 42

SNAPPING AND HINGING ARRANGEMENTS, WATCHES AND ASSOCIATED METHODS

RELATED CASES

This application is a divisional application and claims priority to U.S. Utility application Ser. No. 10/753,737 entitled "Snapping And Hinging Arrangements, Watches and Associated Methods" filed on Jan. 7, 2004, now U.S. Pat. No. 7,146,731 which claims priority to U.S. Provisional application Ser. No. 60/438,755, entitled "Fastenable Timepiece and Associated Methods of Use" filed on Jan. 7, 2003 and to U.S. Provisional Application No. 60/516,661 entitled "Snapping and Hinging Arrangement for Articles and Associated Methods of Manufacturing and Use" filed on Oct. 31, 2003, all incorporated herein by reference in their entirety.

BACKGROUND

1. Field of the Disclosure

The present application relates to snapping and hinging arrangements. More particularly, the present application is directed to snapping and hinging arrangements to be used in fastenable articles, and their associated construction and uses. The present application or disclosure also relates to watches and arrangements, uses and methods associated therewith.

2. Description of the Background Art

When using a fastenable article, it is often desirable to use fastening means which are easy and simple to use. This is particularly true when the fastenable articles are clothing items, such as shoes, belts, phone holders and time pieces.

With reference to the latter case, for example, watches have been typically provided with various buckle-type fastening means in order to fasten portions of the band together and thus secure the timepiece to a wearer's wrist, for example. While this method is sufficient to secure timepieces to a wrist, the intricacies involved in using a buckle/clasp-type of fastening mechanism may prove to be too difficult/complex to operate without encountering difficulty and frustration, especially for young children or persons with limited manual dexterity.

Generally the concept of time is also often difficult and complex for children to comprehend.

A configuration that provides secure fastening and ease of operation, both for fastening and unfastening, as well as a method to teach children how to tell the time and to relate time to various daily events, is clearly needed.

Also, in the case of wristwatches, it is sometimes desirable to transfer the watch from one band to another, for example, to use a band that better coordinates with other fashion items. However, most existing mechanisms used to attach watches to watchbands use very small pins, making the band difficult and time consuming to remove and install. Hence, there is a need for an improved attachment mechanism that provides for quick and easy removal and installation of different watchbands on a wristwatch.

Furthermore, other fashion items, such as pins and broaches are typically attached to clothing and other items using pins, and other mechanisms, that are awkward and difficult to use. The pins can also damage the fabric through which it is inserted. There is need for an improved attachment mechanism for pins and broaches that is easy to use and does not damage the fabric of the item to which it is attached.

SUMMARY OF THE DISCLOSURE

The present disclosure relates to a snapping arrangement and a hinging arrangement to be used in connection with items. In particular, the disclosure relates to a snapping arrangement to be applied on a strap.

The strap can be used for fastening clothing items such as shoes, belts, phone holders etc. One embodiment refers to time measuring devices, such as watches. With reference to watches, the snapping mechanism allows the strap to be secured on a portion of the human body, such as the wrist or the ankle.

The snapping mechanism utilizes cooperation of two assemblies on the strap, a magnet assembly and a metal assembly. The magnet assembly is located proximate to or at one end of the strap. The metal assembly is located proximate to or at the other end of the strap. During use, the magnet assembly is secured to the metal assembly. The magnet assembly becomes secured to the metal assembly through a snap action, where contact between the magnet assembly and the metal assembly is achieved at least in part by means of a magnetic engagement between the magnet assembly and the metal assembly.

Various embodiments are provided due to the different shape and functions of magnet/metal assemblies.

According to a first aspect, a magnet assembly suitable to be connected to a metal assembly in an engaging fashion is disclosed, comprising: an upper portion; and a lower magnetic portion connected with the upper portion.

The magnet assembly is preferably located on a strap, and the lower magnetic portion is preferably connected with the upper portion through the strap.

The upper portion of the magnet assembly preferably includes a protruding element and the lower portion, a recessed region. The protruding element can then engage with the recessed region to secure the magnet assembly in position. The upper portion and lower magnetic portion can also be secured to the strap by means of pressure forces resulting in a press fit, pop-in fit magnet assembly.

According to a second aspect, a magnet assembly suitable to be connected to a substantially flat item, is disclosed, comprising: a cap having an upper part and a lower part; and a lower magnetic portion contacting the cap, the cap securing the assembly to the substantially flat item.

In one preferred embodiment, the lower magnetic portion is partially recessed into the cap.

According to a third aspect, a magnet assembly suitable to be connected to a substantially flat item, is disclosed, comprising: a tip; a lower magnetic portion; and a retention pin.

According to a fourth aspect, a metal assembly, suitable to be secured to a substantially flat item, is disclosed, comprising: one or more rivets; and one or more metal elements. Each of the one or more metal elements has a mating portion and an engaging portion and each of the one or more rivets is connected to each of the one or more metal elements by the engaging portion, thereby securing the assembly to the item. The metal assembly is further connectable to a magnet assembly in a mating fashion.

The metal element and rivets can be switched in the assembly so that the upper part of the rivets constitute the mating portion and the lower part the engaging portion, and the metal elements connect and secure the assembly to the item.

The metal assembly can also comprise a rib connecting the metal elements, preferably adjacent to the metal elements. The rib of the disclosure can be an additional part of the metal elements or integral to the metal element and comprises a spine portion having a plurality of holes and a plurality of mating portions.

Preferred embodiments are ones where the lower magnetic part as well as the mating portion of the metal element/rivet are arc-bean shaped.

According to a fifth aspect, a snapping mechanism or arrangement suitable to secure portions of a substantially flat item, is disclosed. In particular the snapping mechanism or arrangement is suitable to secure portions of the band of a watch, which comprises the magnet assembly and a metal assembly described in the present disclosure. The watch band, including the snapping mechanism of the invention, can easily be put on and taken off. This is particularly advantageous when the watch band is used by children and people with limited manual dexterity.

According to a sixth aspect, a substantially flat item, in particular the band of watch, is disclosed, comprising the disclosed snapping mechanism or arrangement.

According to a further aspect, a process is disclosed for manufacturing a substantially flat item herein disclosed. The process comprises including the snapping mechanism disclosed herein in the substantially flat portion of said item.

The present disclosure also provides a hinging assembly, to be connected to an item, for example to a watch case. In this example, the watchcase including the hinging assembly can be attached to items, for example a strap, in particular the strap described above. Other exemplary items to which the hinging assembly may be attached include, without limitation, clothing items, backpacks and other accessories, for example. An advantage of the hinged watch case according to the invention is the ease in removing and replacing watch bands from the hinged watch case.

In one embodiment, the hinging assembly is combined with and attached to a watch case. However other embodiments are possible, where the hinging assembly is able to be attached to other objects such as jewelry, buttons, fashion items etc.

In particular, the hinging assembly described below is attached to an element to be displayed, shown or just carried, and allows that element to be applied, by means of a spring action exerted through the hinging assembly, on items such as clothing items, bags, books, hats, back pack, straps etc. In case the element is a watch case, the hinging assembly of the invention makes the hinged watch case applicable to various items other than a watch band.

Therefore according to another aspect a leaf spring element is disclosed, having a first lateral portion, a second lateral portion and a central portion acting as a spring and located between the first lateral portion and the second lateral portion.

Each first and second lateral portions have a substantially rectangular shape and comprise a first corner facing the central portion and a slanted leg. Each slanted leg comprises a first leg portion substantially lying in a first plane, and a second leg portion substantially lying on a second plane different from the first plane. In a preferred embodiment the first plane is substantially perpendicular to the second plane. The second leg portion of each slanted leg ends with an hollow section or aperture.

The central portion of the leaf spring element is a bent central portion having a substantially trapezoidal shape and having a first slanted edge and a second slanted edge.

The leaf spring element of the disclosure further comprises first and second cut sections that separate the central portion from the first and second lateral portions respectively. Each of first and second cut sections have a distal end and a proximate end, wherein the distal end is located between the first or second slanted edge and the first corner of the first or second lateral portions.

In a preferred embodiment of the leaf spring element of the disclosure, each of the first and second lateral portions comprises a second corner and a third corner, both distal to the central portion. A first tooth located adjacent the second corner and a second tooth located adjacent to the third corner, are also comprised in each first and second lateral portion. In particular the first and second teeth are located in a third plane and the first and second lateral portions located in a fourth plane different from, and preferably perpendicular to, the third plane.

According to a further aspect, a process for manufacturing a leaf-spring element, is still disclosed, comprising: annealing a material; cutting the annealed material; bending the cut annealed material; and heat treating the bent cut annealed material. Cutting may be accomplished by any appropriate method known in the art. An examplarily useful method utilizes a laser or lasers to cut.

The leaf spring element manufactured by the process of the disclosure is preferably the leaf spring element of the disclosure.

According to a further aspect, a hinging assembly is disclosed, comprising the leaf spring element described herein and a hinge pin allowing connection with an item.

In one aspect, an item comprising the hinging assembly herein described is disclosed, in particular a watch.

According to a further aspect, a base element to be used with a watch case, is disclosed. The base element comprises a substantially circular central portion and two side portions, often referred to as cuffs, connected and integral with the central portion.

The central portion has a first curved edge and a second curved edge and comprises along the first curved edge a hinging region and in proximity of the second curved edge a recessed region. The hinging region allows the base element to be hingedly connected with the watch case and the recessed region provides further connection between the base element and the watch case.

In particular the recessed region can be a locking region which allows locking between the base element and the watch case. The recessed region can also provide a recess for a crown of the watch case.

The side portions of the base element of the disclosure can be substantially trapezoidally shaped. A substantially rectangular region, which can be centrally disposed and slightly raised with respect to a remaining part of the internal side can be included as part of the base element.

According to a further aspect, a hinging assembly is disclosed, which comprises a watch case and the base element described herein.

In particular, a hinge-pin can be positioned in the hinging region of the base element, and connect the watch case with the base element. The watch case can comprise an external side visible during normal use of the watch and an internal side not visible during normal use of the watch. The internal side can have an overall peripheral shape substantially matching a peripheral shape of the base element.

The watch case in the hinging assembly can comprise a crown. In this case the internal side can be so shaped to allow the crown to come into engeageable connection with the recessed region of the base element.

The internal side of the watch case of the hinging assembly may also comprise a substantially rectangular region, which can be centrally disposed and slightly raised with respect to a remaining part of the internal side.

The hinging assembly can be adapted to be used with a watch band. The watch band can be inserted between the watch case and the base element. In particular, the watch band may be hosted in the substantially rectangular region of the watch case, and/or in the substantially rectangular region in the base element. The watch band may comprise a magnet assembly, a metal assembly of the disclosure, or a snapping mechanism of the disclosure.

According to a further aspect, a watchband is disclosed, comprising a portion having a shape substantially matching the shape of a watchcase. The watchband of the disclosure can be advantageously used with the hinging assembly of the disclosure.

The portion of the strap matching the shape of a watchcase is preferably substantially circular or substantially oval.

According to a further aspect, a watch system is diclosed, including a first visual display showing a time, and a second visual display showing indication of an event associated with the time shown by the first display. The event is variable in accordance with the time shown by the first display.

The first display may show time in an analog or in a digital manner according to a 12-hour and/or a 24-hour arrangement. The arrangement may show time only by means of an hour arrangement, or also by means of a hours-minutes or hours-minutes-seconds arrangements. The watch system may also comprise a sound emitting assembly.

The indication of an event in the second display can be an icon thematically associated with the time shown in the first display, as well as a wording, an animation, a sound effect or a combination thereof. An assembly providing at least one of those effect can be comprised in the watch system.

The event can also be variable in accordance with the skills of the user.

According to a further aspect, a method to teach a user how to tell the time, is disclosed. The method comprises the use of the watch system herein described.

According to a further aspect a watch band is also disclosed, to be used in conjunction with a watchcase having an upper surface and a lower surface. The watch band of the disclosure comprises a portion having a shape substantially matching a shape of the lower surface of the watchcase.

Such portion is preferably located in a substantially central position in the strap, and has preferably a substantially circular or a substantially oval shape.

The foregoing and other objects, features and advantages of the present disclosure will be apparent to those of skill in the art from the following detailed description which makes reference to several figures which are exemplary and non-limiting.

BRIEF DESCRIPTION OF THE DRAWINGS

FIG. 9 shows a bottom view of the still further embodiment of FIG. 8;

FIG. 10 shows a perspective view of a magnet portion;

FIG. 11 shows a perspective cross-sectional view of a magnet arrangement including the magnet portion of FIG. 10;

FIG. 12 shows a further cross-sectional view of the magnet arrangement of FIG. 11;

FIG. 13 shows a top view of an embodiment of an exemplary metal arrangement;

FIG. 14 shows a bottom view of the embodiment of FIG. 13;

FIG. 15 shows an exploded cross-sectional view of the embodiment of FIGS. 13 and 14;

FIG. 16 shows a top perspective view of the metal arrangement of FIGS. 13 to 15;

FIG. 21 shows a partial cross-sectional view of another embodiment of the metal arrangement;

FIG. 22 shows a partial perspective cross-sectional view of the embodiment of FIG. 21;

FIG. 25 shows insertion of the metal element of FIG. 24B in a strap;

FIG. 37 shows a perspective view of a first embodiment of a hinging assembly;

FIG. 38 shows a cross-sectional view of the hinging assembly of FIG. 37;

FIG. 39 shows a possible use of the hinging assembly of FIGS. 37 and 38;

FIGS. 41 and 42 show cut sectional view of a watch case;

DETAILED DESCRIPTION OF THE DISCLOSURE

A snapping arrangement is initially disclosed. The arrangement comprises a strap and two cooperating assemblies on the strap, a magnet assembly and a metal assembly. The magnet assembly is located proximate to or at one end of the strap. The metal assembly is located proximate to or at the other end of the strap. During use of the strap, for example on the wrist or ankle of a user, the magnet assembly is secured to the metal assembly. The magnet assembly becomes secured to the metal assembly through a snap action, where contact between the magnet assembly and the metal assembly is achieved at least in part by means of a magnetic engagement between the magnet assembly and the metal assembly.

Several embodiments are shown in the present disclosure exhibiting different shapes and functions of the magnet/metal assemblies.

1. Magnet Assembly

Figure 1:
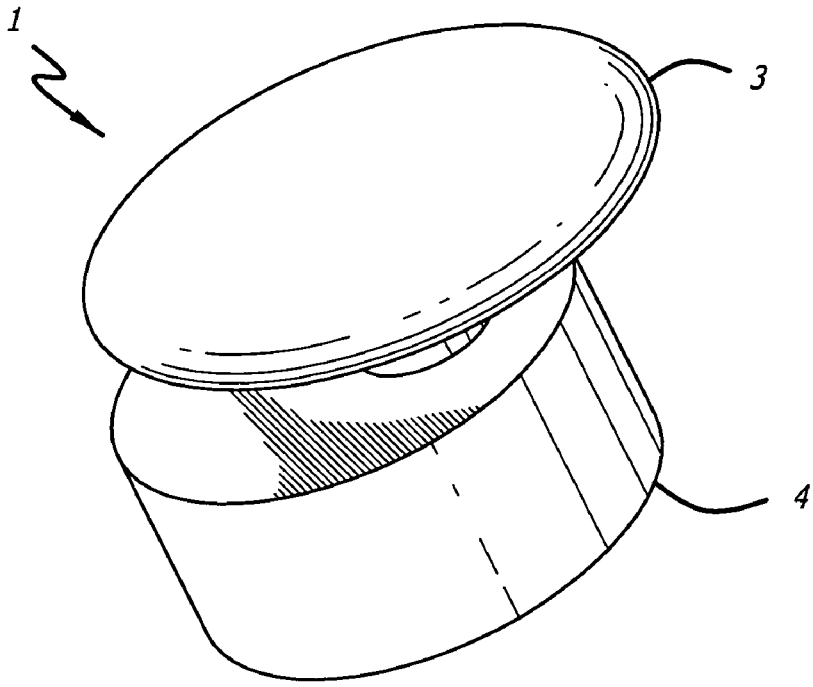
FIG. 1 shows a perspective view of an embodiment of a magnet assembly.
Figure 2:
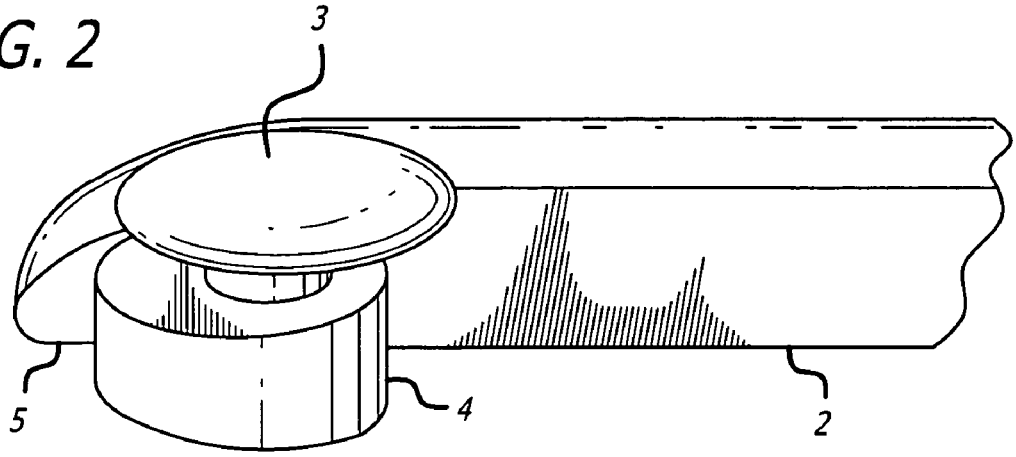
FIG. 2 shows a sectional perspective view of a the magnet assembly of FIG. 1 on a strap.
Figure 3:
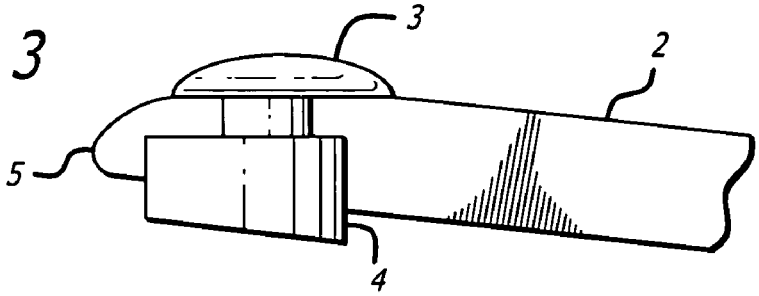
FIG. 3 shows a cross-sectional view of a magnet arrangement comprising the magnet assembly of FIG. 1 and the strap.

FIGS. 1-3 show a first embodiment of a magnet assembly (1) on a strap (2), comprising an upper portion (3) and a lower portion (4). The upper portion (3) is usually button-shaped and does not need to be magnetic. For example, it can be made of plastic. The lower portion (4) is magnetic and can be cylindrical in shape.

The lower portion (4) can be connected with the upper portion (3) in a variety of ways.

For example, the upper portion (3) can have an element protruding from its bottom surface and engaging with a recess in the upper surface of the lower portion (4). To this effect, a hole will be formed in the strap (2), near a tip (5) of the strap. Therefore, the upper portion (3) and the lower magnetic portion (4) pop into place and engage one another, thus forming the magnetic assembly.

Figure 4:
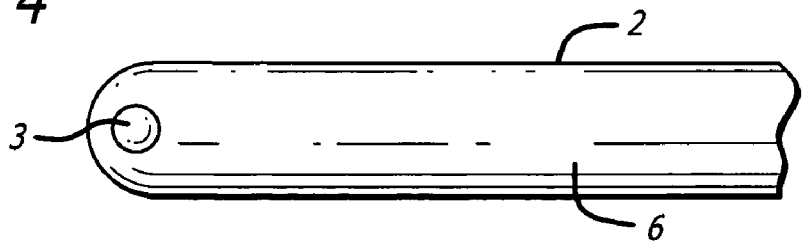
FIG. 4 shows a top view of a further embodiment of the magnet arrangement.
Figure 5:
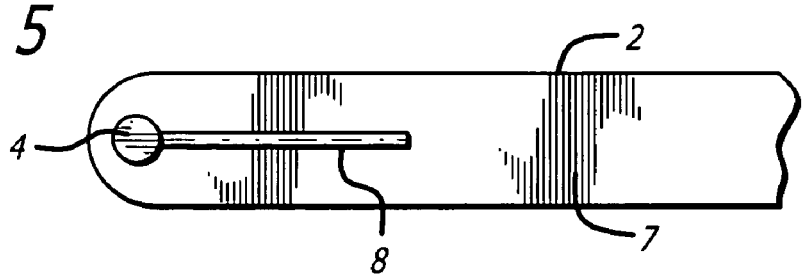
FIG. 5 shows a bottom view of the embodiment shown in FIG. 4.

FIGS. 4-5 show in more detail an upper surface (6) and a lower surface (7) of the strap. With reference to those figures, and alternatively to what is disclosed above, the upper portion (3) of the magnet assembly can be glued together with the upper surface (6) of the strap, and the lower magnetic portion (4) of the magnet assembly can be glued together with the lower surface (7) of the strap. FIG. 5 also shows a rib (8), which could be added to the magnetic assembly to increase stability of the assembly on the strap. A further kind of connection between the upper portion (3) and the lower magnetic portion (4) is a "press fit" connection, where the upper portion (3), the portion of the strap (2) close to the tip (5), and the lower magnetic portion (4) are kept into place by means of pressure forces.

Figure 6:
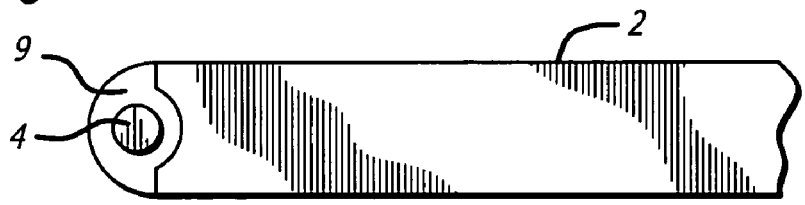
FIG. 6 shows a bottom view of a further embodiment of the magnet arrangement.
Figure 7:
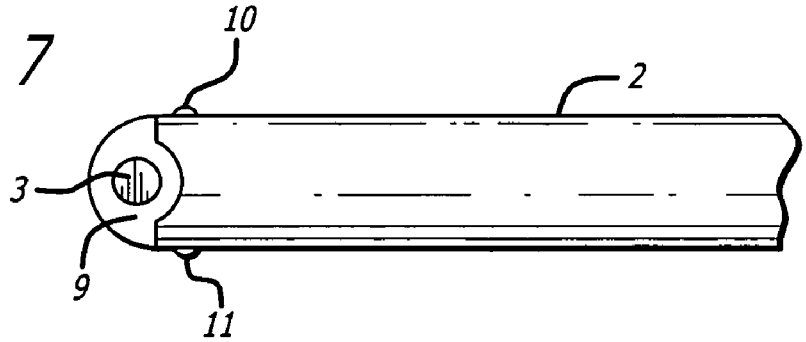
FIG. 7 shows a top view of the further embodiment of FIG. 6.
Figure 8:
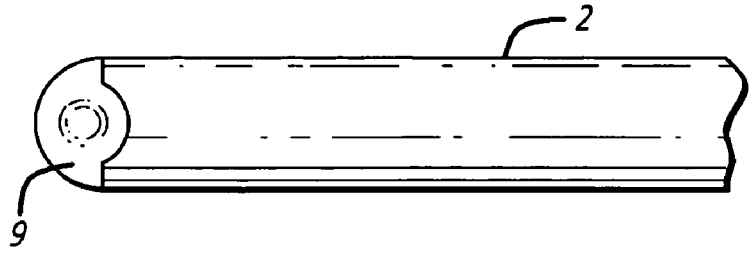
FIG. 8 shows a top view of a still further embodiment of the magnet arrangement.

FIGS. 6-7 show a second embodiment of the magnet assembly on the strap (2), comprising a cap (9), enclosing both the upper portion (3) and the lower magnetic portion (4). The cap (9) forms a space (not shown), between the upper portion (3) and the lower magnetic portion (4), for an end portion of the strap (2) to be inserted before the components of the magnet assembly are snapped into place. Also in this case, a hole will be formed in the strap (2).

It should be noted that the presence of the cap (9) under the upper portion (3) and above the strap (2) on the non-magnetic side of the magnet assembly provides a pleasant aesthetic, mushroom-like aspect. Additionally, stability of the end portion of the strap is improved. Alternatively the cap itself could also provide a tip of the strap, thus not requiring the strap to be placed in the middle of the cap. Connection between the cap/tip and the strap (2) can be achieved by mechanical means, such as screws (10, 11) as schematically shown in FIG. 7.

Alternatively to what is shown in FIGS. 6 and 7, the cap (9) can be provided instead of (and not in addition to) the upper portion (3). In this case, the aesthetic effect due to the presence of the upper portion can be obtained by suitable reshaping of the cap element (9).

FIGS. 8-12 show a third embodiment of the magnet assembly on the strap (2), where cap (9) also acts as upper portion. In this embodiment, the lower magnetic portion of the magnet assembly is provided by an arc- or bean-shaped element (13). The shape of the element (13) is better shown in perspective in the enlargement of FIG. 10. FIGS. 11 and 12 are partial cross sections better showing some of the details of the third embodiment. In particular, the cap (9) comprises a recessed area (14) on its top. Additionally, a retention pin (15), preferably a metal retention pin, is provided to connect the strap (2) with the cap (9). In this way the whole assembly, including lower magnetic portion (13), is kept in place by means of mechanical forces. If desired, an upper portion, as shown in the previous FIGS. 1-4, can be provided in place of the recessed area (14). It should be noted that the connection between the upper portion and the lower magnetic portion (12) can be obtained in a variety of ways, easily determinable by the person skilled in the art upon reading of the present disclosure. For example, the arc-shaped portion could be press-fit into the cap portion, or partially recessed into the cap portion.

2. Metal Assembly

The metal assembly is located on an end of the strap (2) opposite the end on which the magnet assembly is located. In this way, when the strap (2) is closed, in a circular fashion, one assembly will mate with the other.

FIGS. 13-16 show a first embodiment of a metal assembly on the strap (2). The metal assembly comprises a plurality of rivets (16), each having a top or mating surface (17) and a bottom or engaging surface (18), as shown in the exploded view of FIG. 15. Each rivet (16) engages into a corresponding metal element (19) by means of its engaging surface (18), as also shown in the exploded view of FIG. 15. The metal elements (19) are located on the lower surface (7) of the strap (2), proximal to the skin of the user. The rivets (16) are located on the upper surface (6) of the strap (2), distal to the skin of the user, during use. The substantially circular shape of the mating surfaces (17) corresponds to the substantially circular shape of the bottom surface of the lower magnetic portion (4) of the magnet assembly, shown in some of the previous Figures. Magnetic engagement of the bottom surface of the lower magnetic portion (4) with one of the mating surfaces (17), one of the mating surfaces (17) being chosen among the others in accordance with the desires or size of the wrist or ankle of the user, allows closure of the strap (2). Of course, stability of the closure of the strap (2) is maximized when there is geometric correspondence between the bottom surface of the lower magnetic portion (4) of the magnet assembly and the mating surface (17). However, geometric correspondence between the mating surfaces is just a preferred embodiment, and not a necessary feature of the present disclosure. Additionally, the person skilled in the art will recognize, upon reading of the present disclosure, many geometric alternative shapes, such as square, rectangular, triangular, hexagonal, etc. shapes, both for the bottom surface of the lower magnetic portion (4) of the magnet assembly and the mating surface (17), are possible.

Pressed rivet technology, preferably used to realize the assembly of FIGS. 13-16, is known to the person skilled in the art and does not need to be described in detail. For example, an overmolding process could be used, i.e. the strap (2) is first molded and then the rivets (16) and metal elements (19) are molded into the strap (2), on opposite surfaces (6, 7) thereof.

Figure 17:
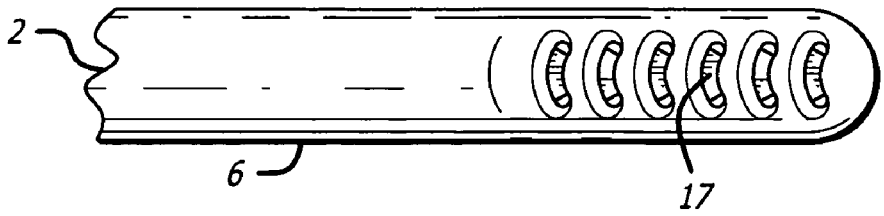
FIG. 17 shows a top view of a further embodiment of the metal arrangement.
Figure 18:
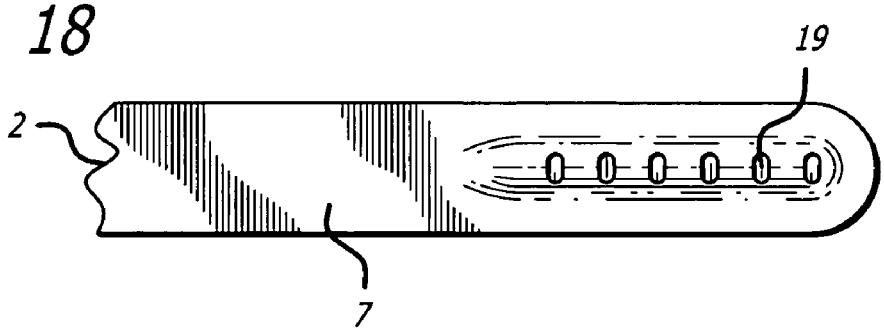
FIG. 18 shows a bottom view of the further embodiment of FIG. 17.

FIGS. 17-20 show different shapes of the rivets and metal elements. For example, the shape of the mating surfaces of FIG. 17 is suitable for use with the lower magnetic portion (13) shown in FIG. 10. Spacing between the rivets (16) determines the number of rivets and consequently, the number of different sizes of the strap (2). In case the shape of the rivets (16) is such that the mating portion (17) is circular, spacing between the rivets (16) cannot be less than the diameter of the rivets (16), thus reducing the available design choices. For example, spacing between the rivets (16) in these embodiments is usually about 10 mm (about 0.4"). However, it should be noted that an arc- or bean-shape allows a better stability of the metal elements (19) when pressed into the strap. In particular, arc/bean-shaped metal elements have less tendency to pivot than circularly-shaped metal elements. Additionally, the presence of arc/bean shaped metal elements instead of circular elements allows for tighter spacing between the rivets (16), thus permitting a higher number of different sizes to be provided on the strap (2).

Figure 19:
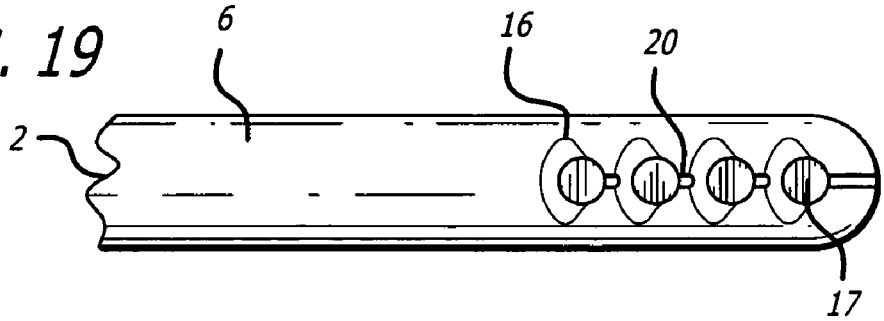
FIG. 19 shows a top view of a still further embodiment of the metal arrangement.
Figure 20:
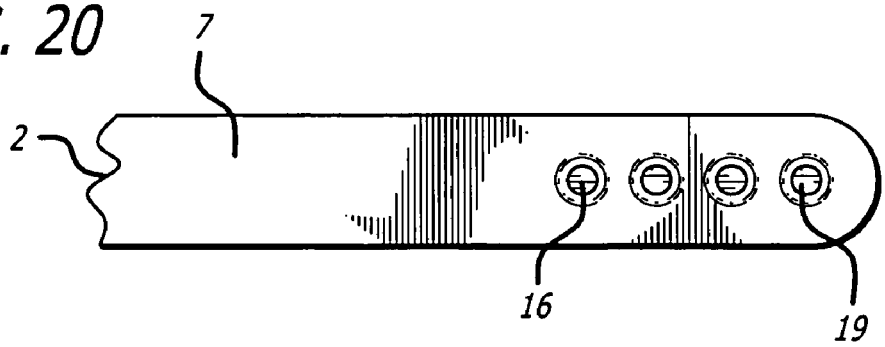
FIG. 20 shows a bottom view of the still further embodiment of FIG. 19.

The metal assembly structure can be reinforced by means of a rib or spine structure (20) placed in the strap (2) and mechanically connecting the various elements of the metal assembly, as shown, for example, in FIG. 19. The presence of a reinforcing structure provides for a better stability of the assembly and helps avoid undesired pivoting movement of the rivets and metal elements during use of the strap (2). According to a first aspect (not shown in the Figures), the rib structure could be additional to, or independent from, the plurality of rivets (16) and metal elements (19), to be placed, for example, between the rivets (16) and the metal elements (19), and comprising a plurality of holes in correspondence with the junction between each metal element and its corresponding rivet.

FIGS. 21-22 show a partial cross sectional view and a partial perspective view, respectively, of a second embodiment (21) of the rib structure, where the rib structure (21) is integral with the plurality of metal elements. Therefore, according to this second embodiment as shown in detail in FIG. 22, the integral rib structure (21) comprises a spine portion (22) comprising a plurality of holes (23) and a plurality of mating metal portions, each having a first side (24A) and a second side (24B), placed in correspondence with a hole (23) and having a shape matingly corresponding to the shape of a lower magnetic portion (4) of the magnet assembly (1).

Figure 23:
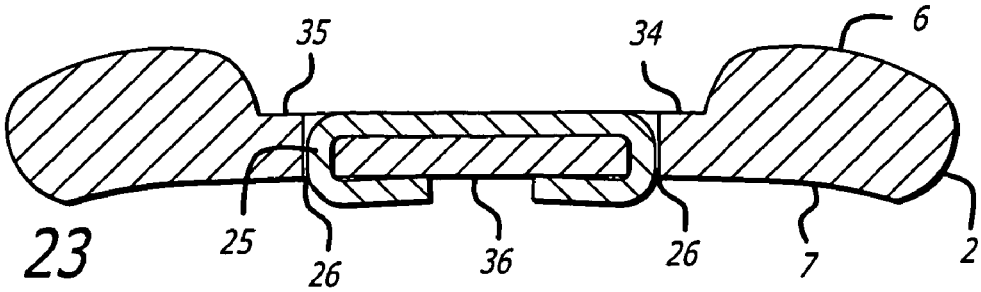
FIG. 23 shows a front cross-sectional view of another embodiment of the metal arrangement.

According to a further embodiment of the metal assembly in accordance with the teachings of the present disclosure, the metal-element/rivet combination is replaced by a plurality of staple elements. FIG. 23 is a cross-sectional view and shows one of the staple elements (25) inserted into corresponding openings or slots (26) of the strap (2). In particular, the strap (2) is provided with two slots (26) for each of the staple elements (25) to be placed.

Figure 24A:
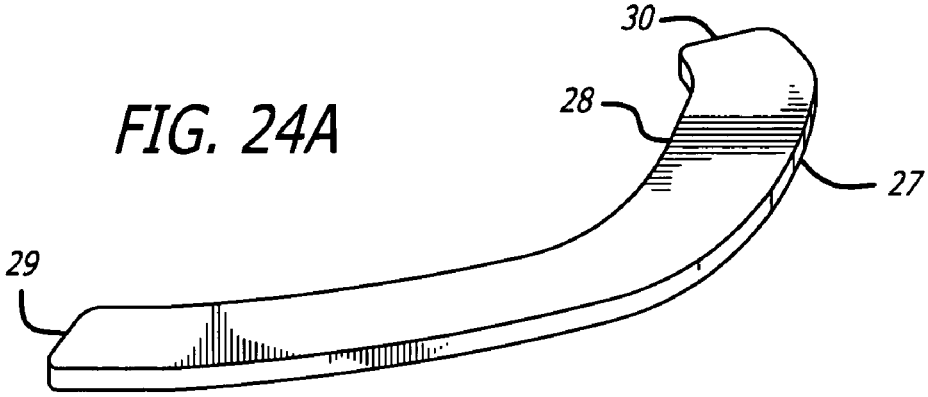
FIGS. 24A-24C show a metal element in a stamped and tumbled condition, in a bent condition and in a folded condition.
Figure 24B:
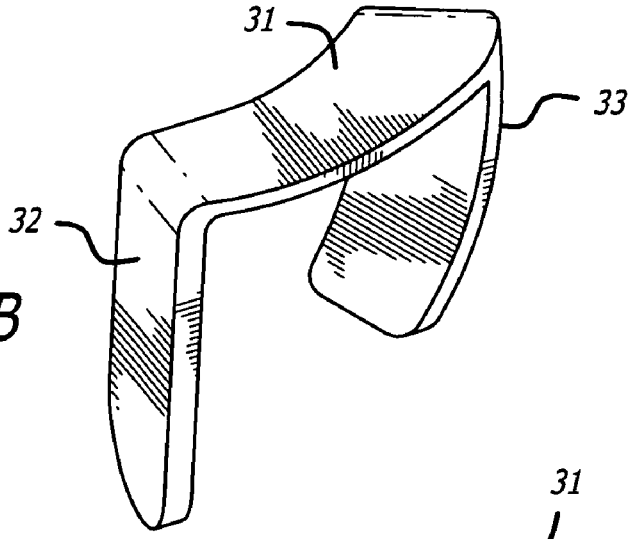
Figure 24C:
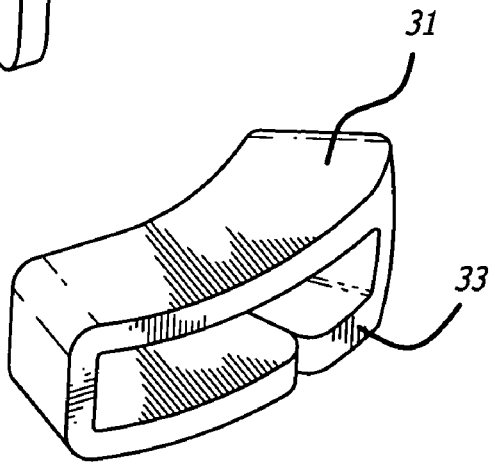
Figure 26:
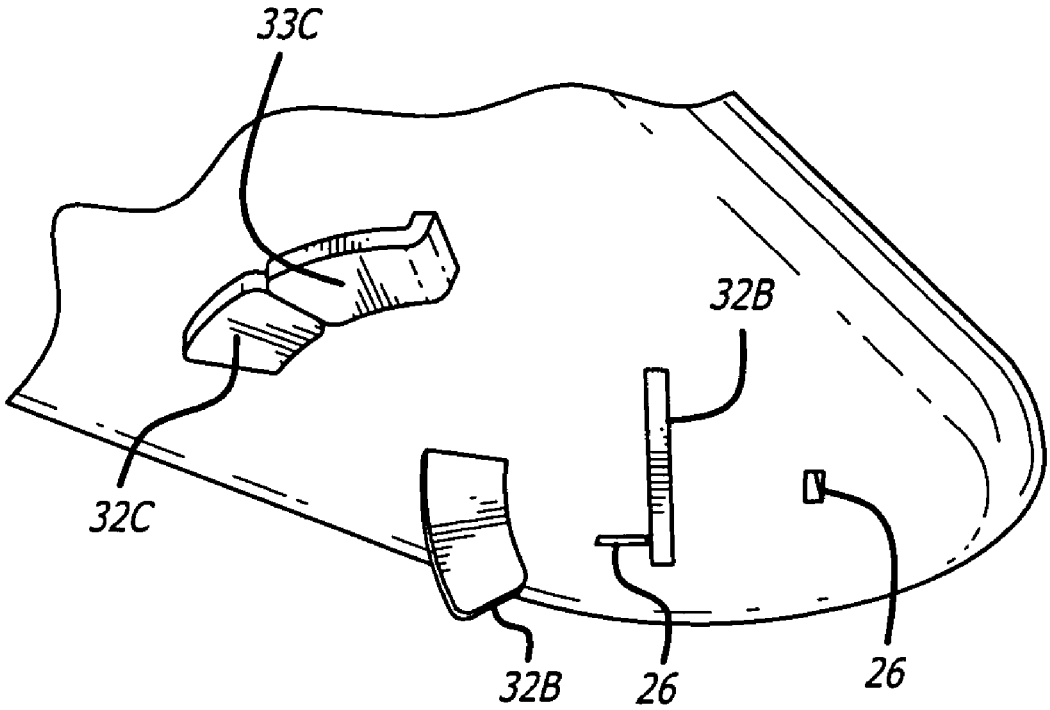
FIG. 26 shows a partial bottom perspective view of a strap and a metal element.

FIGS. 24A-24C show the various shapes of each staple element (25) during a manufacturing process. During the manufacturing process, each staple element initially exhibits a first stamped and tumbled condition (A), FIG. 24A, with an arcuated, for example substantially semi-circular, shape, having an outer periphery (27), an inner periphery (28), and two lateral ends (29, 30). The staple undergoes a first bending operation, FIG. 24B, and is bent along its lateral ends (29, 30) to provide a bent condition (B) comprising an upper, unbent, mating portion (31), a first bent portion (32) and a second bent portion (33). Further to this, one or more staples are inserted into the strap (2), as shown in FIG. 25. Each staple is placed or loaded into position by inserting its first and second bent portions (32, 33) into slots (26) provided in the strap (2) and shown in FIGS. 25 and 26. At the end of this step, the mating portions (31) of each loaded staple in its condition (B) have reached their position in the strap (2). Subsequent to this, the first and second bent portions (32, 33) are bent or folded again, this time around the strap (2), to reach a completely folded condition (C), as shown in FIG. 24C, which shows a staple alone for clarity reasons. FIG. 26 shows this last step in more detail, showing the bent portions (32, 33) both in their (B) condition (32B, 33B) and their (C) condition (32C, 33C).

As shown in FIGS. 23 and 25, the preferred embodiment also provides for a particular structure of the area surrounding the slots (26) for each staple (25). In particular, for each staple (25), the region comprising the two slots (26) is recessed and comprises a step-like structure with two raised or stepped portions (34, 35) and one lower flat portion (36), on which the staple (25) is to be placed. Each slot (26) is placed in correspondence to the region between a stepped portion (34, 35) and the flat portion (36). In this way, a more stable mechanical structure is obtained, and the overall shape also has a more pleasant aesthetic aspect.

3. The Strap

The magnetic and metal assembly have been described heretofore with reference to a strap. However, it should be noted that they could be applied on any arrangement for which a cooperation between two mating elements is required. Key-holders, wallets, belts, etc. represent possible, non-limiting examples, of elements on which the assemblies could cooperate.

Figure 27:
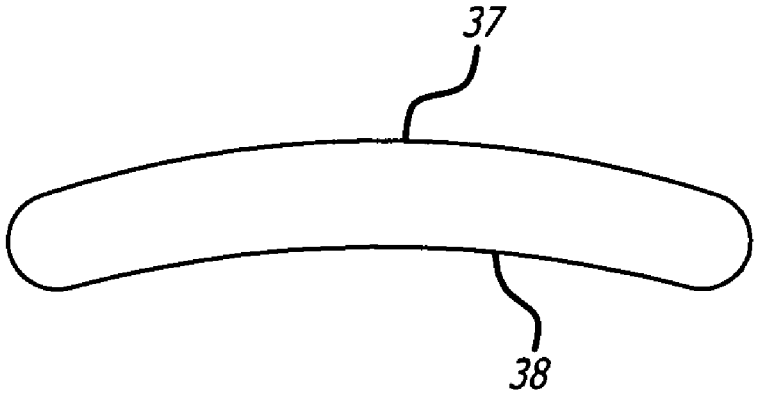
FIG. 27 shows a cross-sectional view of a strap.
Figure 28:
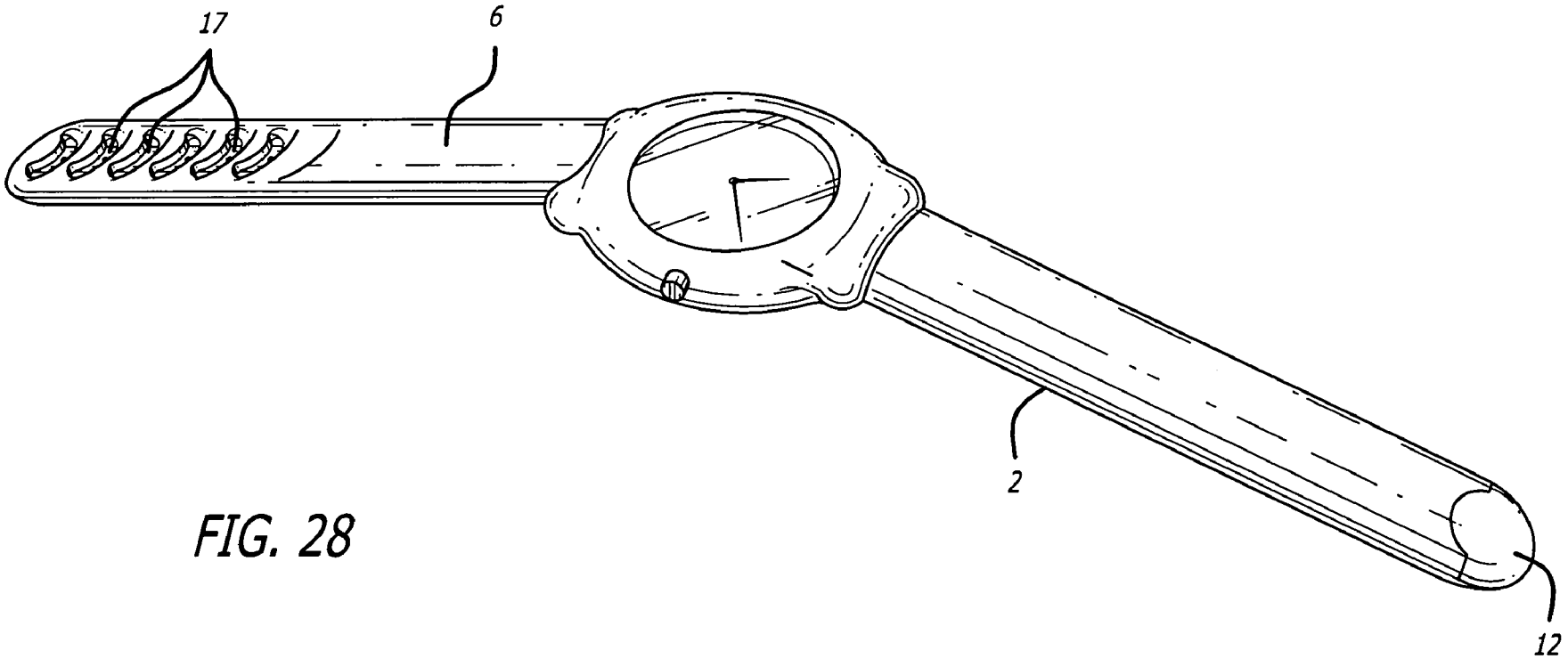
FIGS. 28-32C show watches embodying exemplary snapping arrangements.
Figure 29:
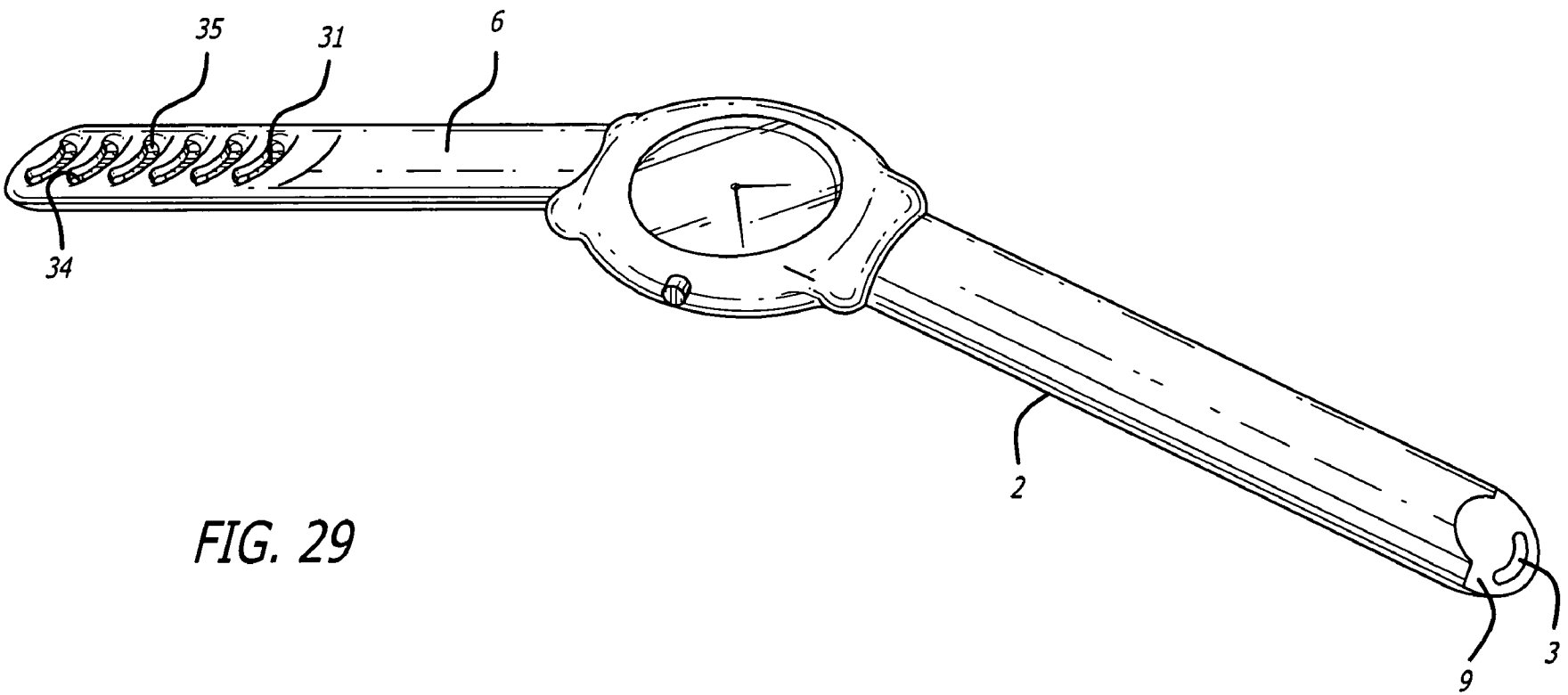
Figures 30A, 30B:
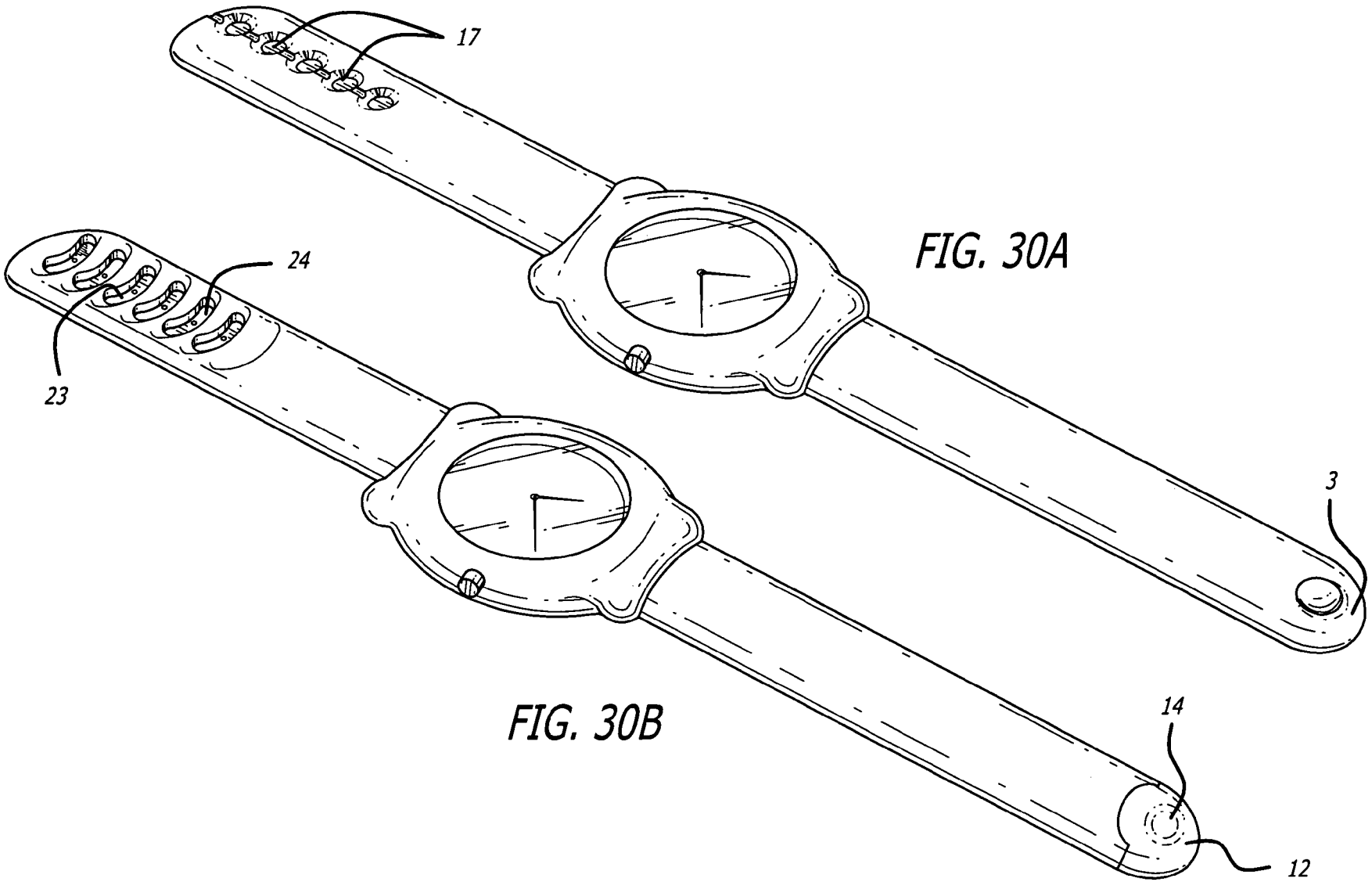
Figure 31A:
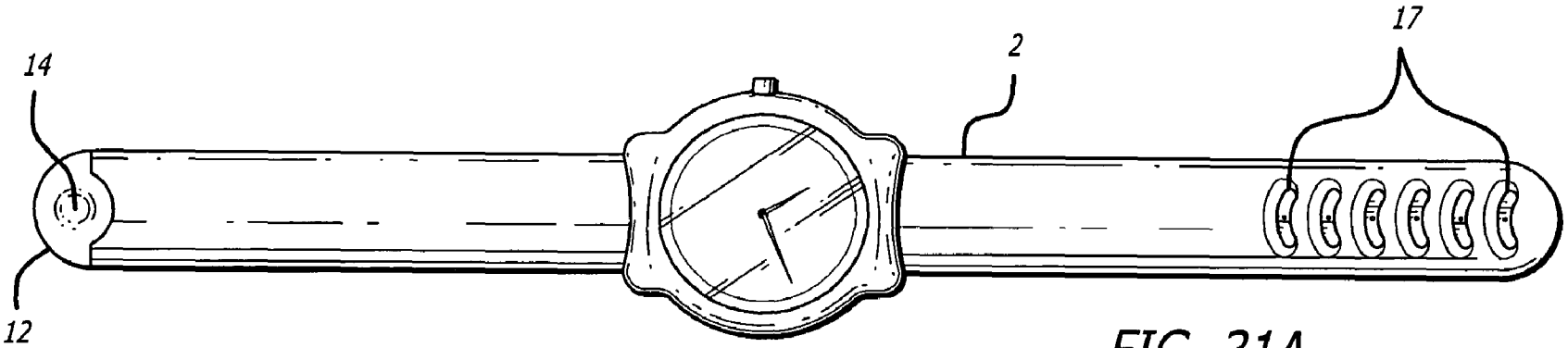
Figure 31B:
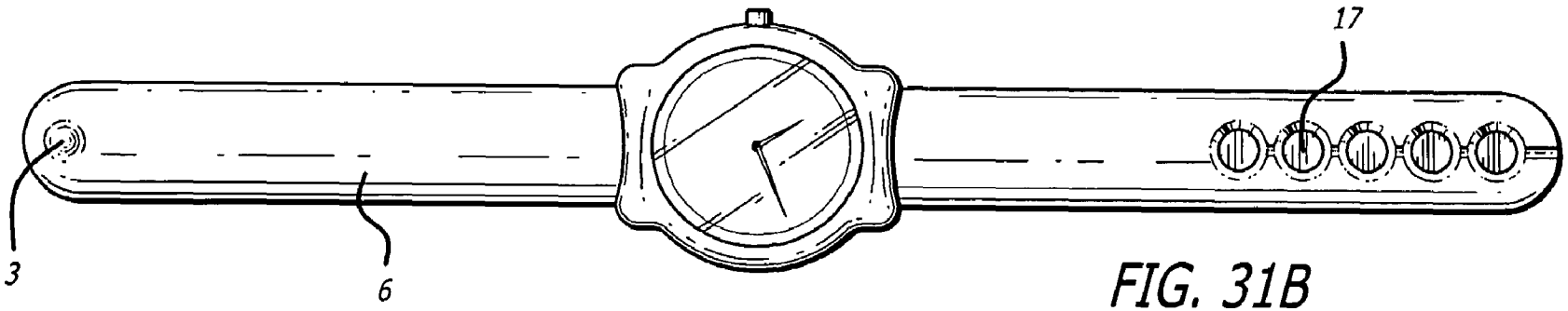
Figure 32A:
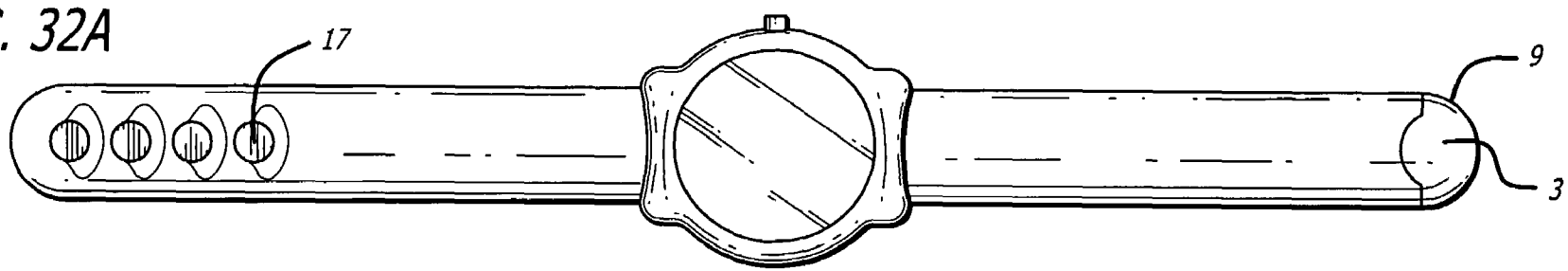
Figure 32B:
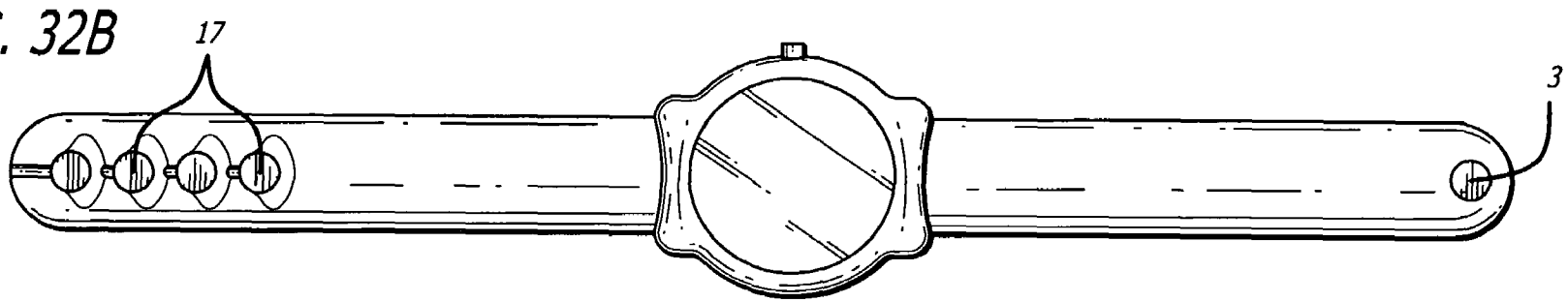
Figure 32C:
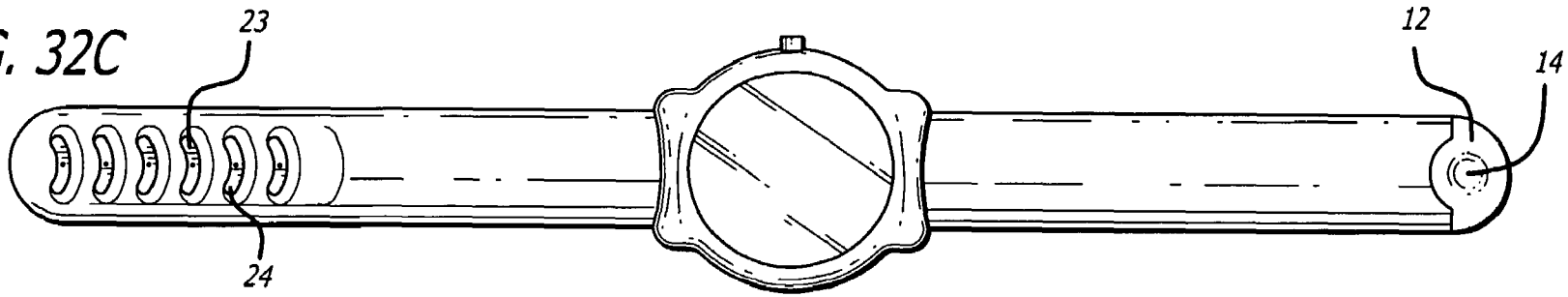

With reference to the strap, such strap could be of any material or shape. Should printing on the strap be required, a preferred embodiment shown in cross-section of the strap is shown in FIG. 27 and provides for a smooth convex upper surface (37) of the strap and a smooth concave lower surface (38) of the strap.

In a further preferred embodiment, the strap of the disclosure may include a portion having a shape that matches the shape of the interior surface of a watchcase. Such portion is preferably substantially centrally located in the strap. In particular the portion can have a substantially circular or oval shape and may be used with a hinging assembly later disclosed in the present disclosure. See, for example, the embodiments shown in FIGS. 40 and 45B, below.

4. The Watch

The strap described heretofore can be used to attach clothing items such as shoes, belts, phone holders etc. In particular, the strap of the present disclosure can be the band of a watch.

FIGS. 28-32C show various watches embodying exemplary snapping arrangements described according to the present disclosure, and will not be described herein in detail, as theses embodiments are understandable to the person skilled in the art, in light of the present disclosure.

5. The Hinging Mechanism

The present disclosure also provides a hinging mechanism to be connected to an item, such as a watch case. The hinging mechanism allows the watch case to be attached, for example, to a strap as described above or to other straps and also allows the watch case to be applied to items unrelated to the watch, such as clothing items.

The hinging mechanism according to the present disclosure is shown in perspective in FIG. 37 and may comprise a leaf spring element, as shown in FIGS. 33-36, which disclose a multi-step process for forming the leaf spring element.

Figure 33:
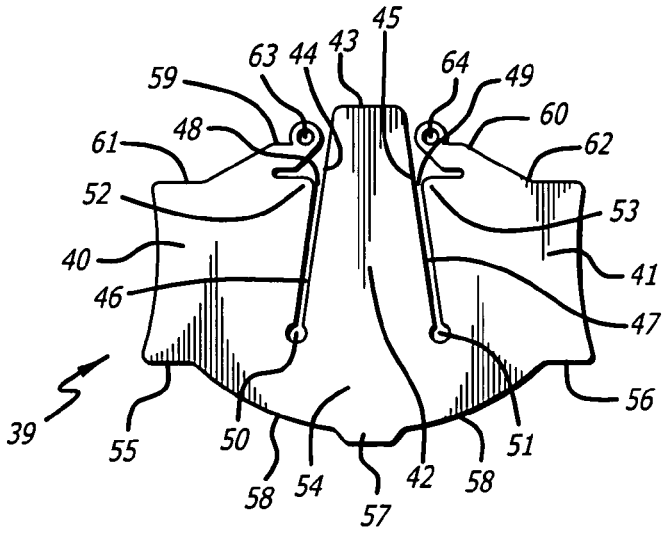
FIG. 33-36 show a leaf-spring element.

FIG. 33 shows the leaf spring element (39) after a first annealing and cutting operation. The leaf spring element can be made of steel. Cutting can be performed by laser cutting, or any other appropriate cutting operation, as known in the art, and will not be here described in detail. The leaf spring element (39) of FIG. 33 comprises three main portions: a first lateral portion (40), a second lateral portion (41) and a central portion (42). The central portion (42) will act as a spring and is located between the first lateral portion (40) and the second lateral portion (41). The central portion (42) has a substantially trapezoidal shape, with an upper edge (43) and two slanted edges (44, 45). Each of the two lateral portions (40, 41) has a substantially rectangular shape. Preferably, one of the two lateral portions (40, 41) is the mirror image of the other. A first cut section (46) and a second cut section (47) separate the central portion (42) from the first and second lateral portions (40, 41), respectively. Preferably the first and second cut sections (46, 47) are specular to each other. The first cut section (46) is substantially parallel to the first (44) of the two slanted edges of the central portion (42). The second cut section (47) is substantially parallel to the second (45) of the two slanted edges of the central portion (42). In a preferred embodiment, both cut sections (46, 47) extend only along a part of the slanted edges (44, 45) of the central portion (42). Each cut section (46, 47) has an upper or distal end (48, 49) and a lower or proximate end (50, 51). The upper or distal end (48, 49) of each cut section (46, 47) is formed by a combination of a part of the shape of the slanted edge (44, 45) of the central portion (42) with one of the first corners (52, 53) of the first or respectively second lateral portion (40, 41). The lower or proximate end (50, 51) of each cut section has a circular contour.

The bottom region (54) of the leaf spring element (39) is an integral combination of the bottom regions of the central portion (42) and the two lateral portions (40, 41). In particular, the bottom region (54) has a semicircular overall shape, trifurcated at the top. In other words, the top portion of the bottom region (54) merges with the lower portions of the central portion (42) and the two lateral portions (40, 41). More specifically, the lower edge of the central portion (42) completely merges into the bottom region of the leaf spring element (39), while the lower edge of each of the lateral portions (40, 41) only partially merges into the bottom region (54) of the leaf spring element, the remaining portion of each lower edge forming two specular bottom side edges (55, 56) of the leaf spring element (39).

A small trapezoidal region (57) is also present, in correspondence with the central portion of the lower or outer semicircular edge (58) of the bottom region (54). Finally a protruding slanted leg (59, 60) is formed on the top edge (61, 62) of each of the lateral portions (40, 41). Each leg (59, 60) ends with a hollow section (63, 64). The hollow sections (63, 64) will cooperate with a hinge pin, later shown, to allow engagement of the leaf spring element (39) with a watch case, for example.

Figure 34:
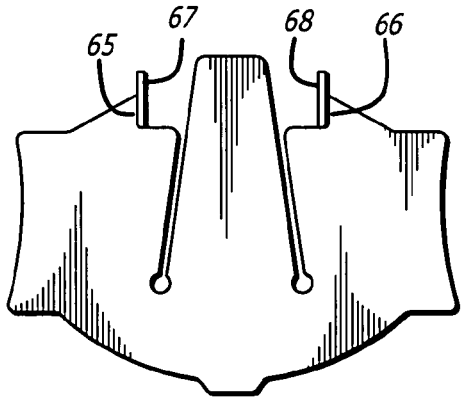

FIG. 34 shows the leaf spring element after a bending operation of legs (59, 60). In particular, only a portion of the legs (59, 60) is bent, so that each leg now comprises a first leg portion (65, 66) substantially lying on a first plane and a second leg portion (67, 68), substantially lying on a second plane different from, and preferably substantially perpendicular to, the first plane. The second plane where the second leg portions (67,68) lie, is also preferably substantially perpendicular to a plane formed by the two lateral portions (40, 41). Additionally, the two second leg portions (65, 66) are substantially parallel to each other, to allow a correct lining up of a hinge pin, to be later described, once the hinge pin is inserted into the circular hollow sections (63, 64).

Figure 35:
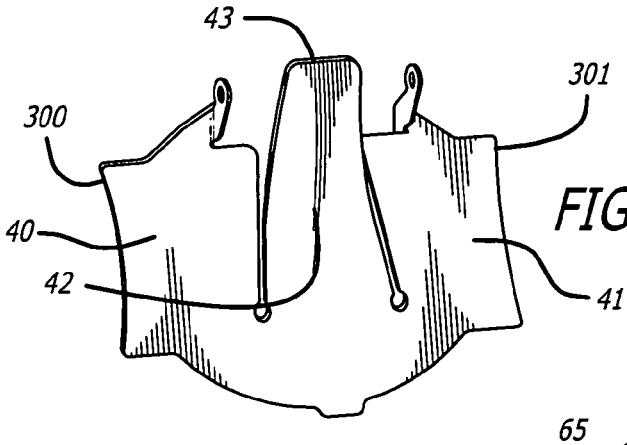

FIG. 35 shows the leaf spring element after a further bending operation, where an upper part of the central trapezoidal portion (42) is bent towards the plane formed by the second leg portions (67, 68). Once bending of the central portion (42) is terminated, the central portion will exhibit a bending along its surface which attenuates as it approaches the proximity of its lower edge and is maximum in proximity of its upper edge (43).

A further bending operation (not shown) of the first and second lateral portions (40,41) may be performed. Once bending of the first and second lateral portions (40,41) is terminated, each lateral portion will exhibit a bending along its surface which attenuates as it approaches its lateral side edges (300, 301) and is maximum as it approaches the central portion.

Figure 36:
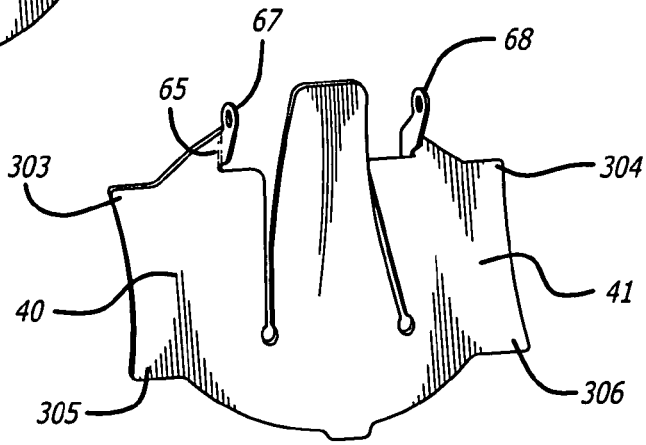

FIG. 36 shows a further step, where the leaf spring element of FIG. 35 is heat treated. Preferably, before heat treating, teeth are formed, through bending (not shown) of second corners (303,304) and third corners (305,306) of the first and second lateral portions (40, 41).

FIG. 37 shows a perspective view of the leaf spring element (39) when connected to a watch case (69), for example by means of the bent upper edge (43) and a hinge pin (70) placed through the hollow sections (63, 64) shown in the previous Figures. FIG. 37 also shows teeth (71) on the spring leaf element (39), for example square or rectangular teeth. The teeth (71) are preferably formed before cutting and bending of the second and third corners of the lateral portions (40,41). The teeth (71) allow better grasping of the item which will contact the spring element (39), to be placed, during use, between the spring element (39) and the watch case (69).

FIG. 38 shows a partial cross sectional view of the arrangement shown in FIG. 37, showing, in better detail the leaf spring element (39), one of the second leg portions (67) and the hinge pin (70).

FIG. 39 shows one of the possible uses of the hinging assembly, e.g., on a shirt of a user.

Figure 40:
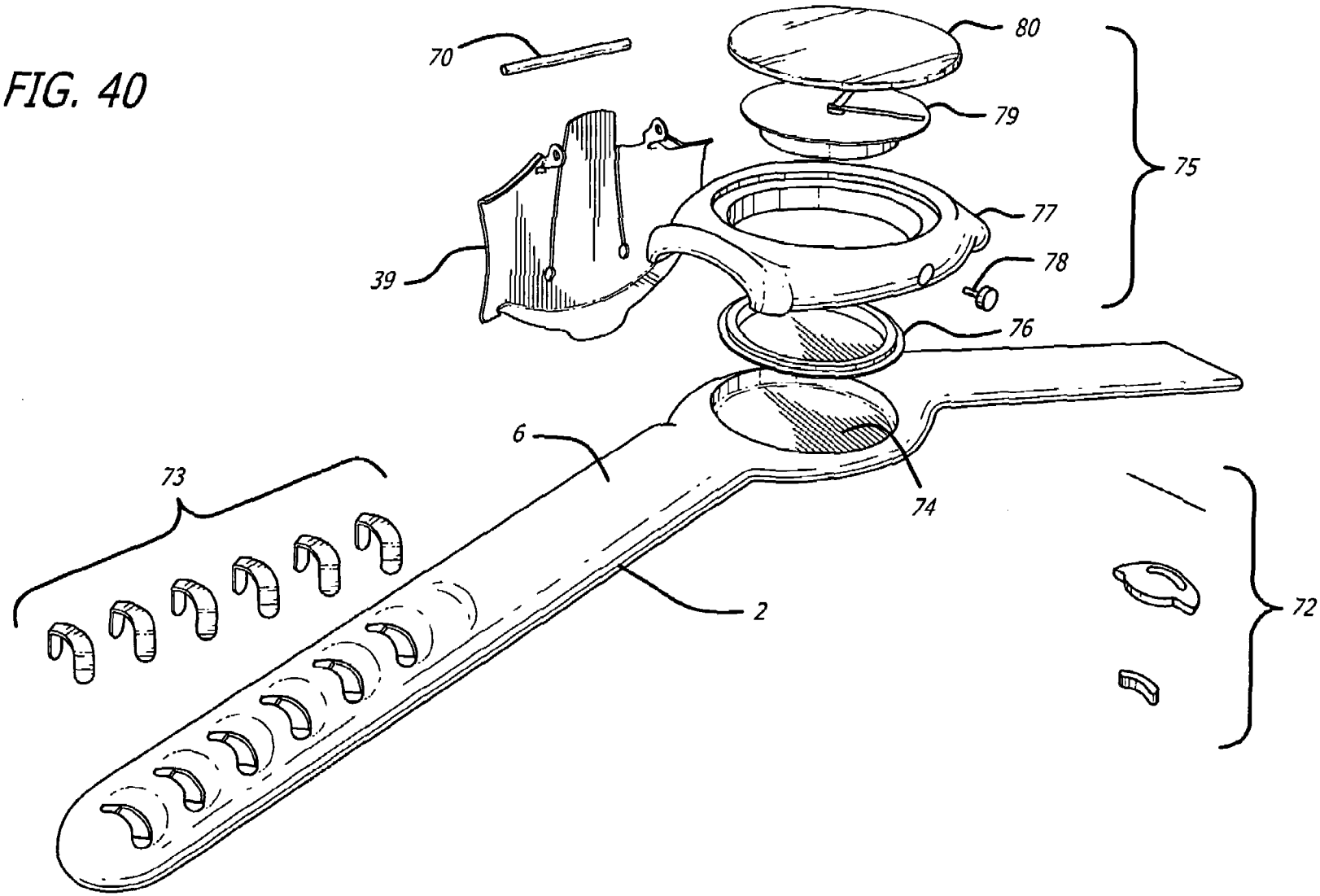
FIG. 40 shows an exploded view of a strap with a magnet assembly and a metal assembly.

FIG. 40 shows a perspective exploded view of a strap (2), with a magnetic assembly (72) and a metal assembly (73). The two assemblies have already been described with reference to some of the previous figures. The strap (2) also comprises a central circular recessed region (74), hosting the watch case (75). Also the watch case (75) is shown in an exploded view and comprises a lower plate or back plate (76), a casing (77), a crown (78), a watch surface or dial surface (79), and a lens (80). It will be appreciated that the structure of the watch case (75) is modular and easily assemblable. In particular, the lower plate (76) will fit into the recessed region (74), the casing (77) will be placed above the lower plate (76), the watch surface (79) will fit into the lower plate (76) and the casing (77) and the lens (80) will be placed above the watch surface (79). Also shown is an exploded view of the leaf spring element 39 and the hinge pin 70.

FIGS. 41 and 42 show cut sectional views of the watch case (75), together with the leaf spring element (39) and the pin (70).

Figure 43:
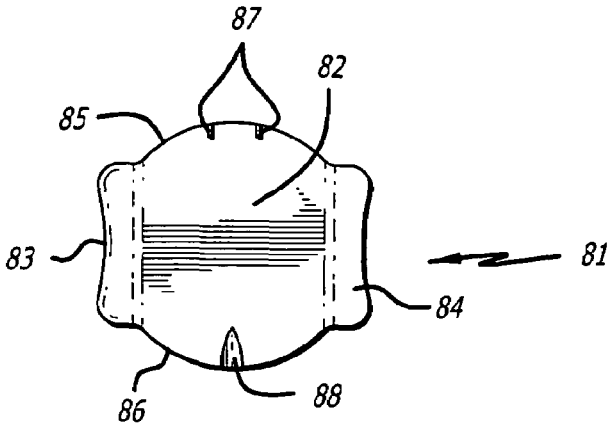
FIG. 43 shows a top view of a base element to be used in a further embodiment of the hinging assembly.

A further embodiment of the hinging mechanism of the present disclosure may also comprise a base element as shown in FIG. 43 to replace the leaf spring element shown in the previous figures.

FIG. 43 shows a top view of a base element (81), i.e. a view of the internal side of the base element (81). The base element (81) comprises a substantially circular central portion (82) and two side portions (83, 84) connected with the central portion and integral therewith. In particular, the central portion (82) exhibits curved edges (85, 86). The central portion (82) comprises, along its curved edge (85) a hinging region (87), for example hinging cavities, which allow the base element (81) to be hingedly connected with the watch case. The central portion (82) further comprises a recessed region (88) located in proximity of its curved edge (86) to either allow locking of the base element (81) with the watch case or to provide a recess for the crown of the watch case.

The edges of the side portions (83,84) may be bent to allow a better grasping of the item to be hosted in the hinging assembly (81).

The base element (81) may also comprise a path-providing region (203) allowing an item, such as a watch band, to be inserted. In particular, the region (203) can be a recessed region and include slightly raised edges. Preferably the shape of the region (203) matches the shape of the watchband to be hosted.

Figure 44A:
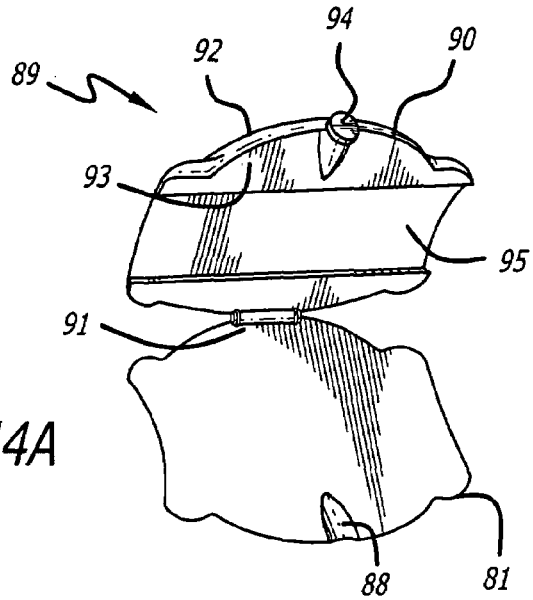
FIGS. 44A and 44B show two different embodiments of hinging assemblies comprising a base element.
Figure 44B:
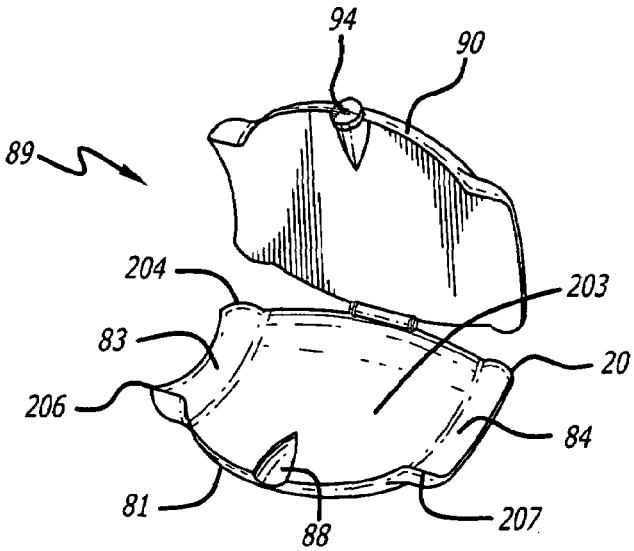

FIG. 44A and FIG. 44B show two different embodiments of the hinging assemblies comprising a base element. In the embodiment of FIG. 44A, the base element (81) is flat. In the embodiment of FIG. 44B the base element is slightly concave. In particular, FIG. 44A shows a hinging assembly (89) comprising the base element (81) connected with a watch case (90) by means of a hinge-pin (91) positioned in the hinging region (87). The hinge-pin (91) can be a spring-hinge. The watch case (90) has an external side (92) visible during normal use of the watch and an internal side (93) not visible during normal use of the watch. The internal side (93) has an overall peripheral shape substantially matching the peripheral shape of the base element (81). The internal side (93) allows the crown (94) to come into engageable connection with the recessed region (88) of the base element (81), for example after a watch band is inserted between the watch case (90) and the base element (81), as shown in the following figures.

The internal side (93) of the watch case (90) also differs from the base element (81) in that it comprises a region (95), for example a substantially rectangular region (95) centrally disposed. The region (95) has slightly raised edges in order to better allow the watch band to be inserted within the assembly (89). The region (95) could also be slightly recessed with respect to the remaining part of the internal side (93). Te region (95) substantially corresponds to the region (203) of the base element (81) previously discussed in FIG. 43. Region (95) may have different shapes matching the shape of the item to be inserted in the hinging assembly. When the item is a strap including a substantially oval portion matching the oval shape of a watchcase, the region (95) has preferably a substantially oval shape.

FIG. 44B shows a further embodiment of the hinging assembly (89), wherein the watch case (90) does not include a region such as region (95) of FIG. 44A and the base element (81) includes the region (203) already described with reference to FIG. 43. In this embodiment, the region (203) is recessed with respect to the remaining part of the internal side of the base element (81), has a substantially oval shape, and no slightly raised edges. The side portions (83,84) are bent along upper edges (204,205) and lower edges (206,207) to allow a better grasping of the watch band to be hosted in the region (203).

Figure 45A:
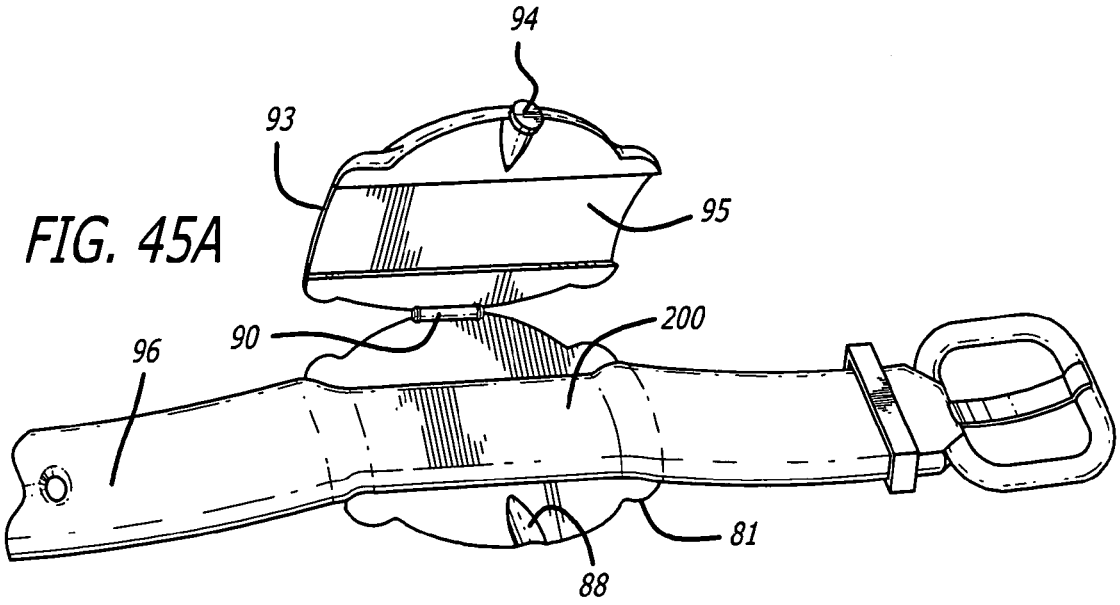
FIGS. 45A and 45B show a hinging assembly in an open condition hosting a watch band.
Figure 45B:
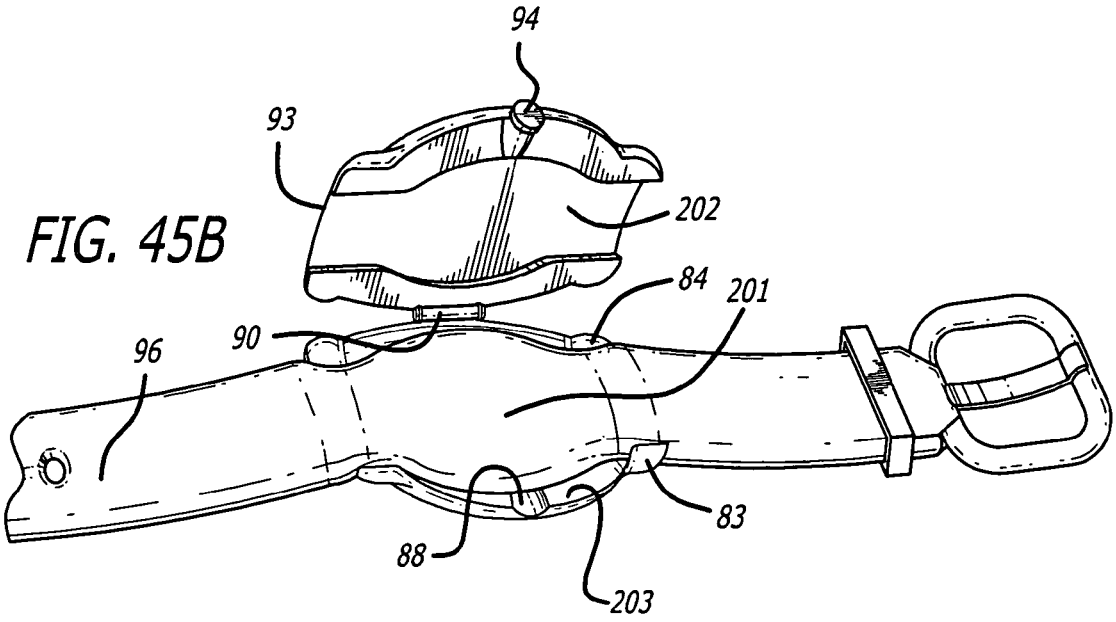

FIGS. 45A and 45B show the hinging assembly (89) in an open condition hosting a watch band (96). FIG. 45A shows a first embodiment, where the hinging assembly according to the embodiment of FIG. 44A is employed, and where the watch band (96) is a strap having a substantially rectangular portion in the portion matching with region (95). FIG. 45B shows a further embodiment, where a hinging assembly substantially similar to the hinging assembly according to the embodiment of FIG. 44B is employed, and where the watch band is a strap having a central substantially oval portion (201). The oval portion (201) matches with an oval embodiment (202) of the region (95). The oval portion (201) lies on the region (203) in the base element.

Figure 46:
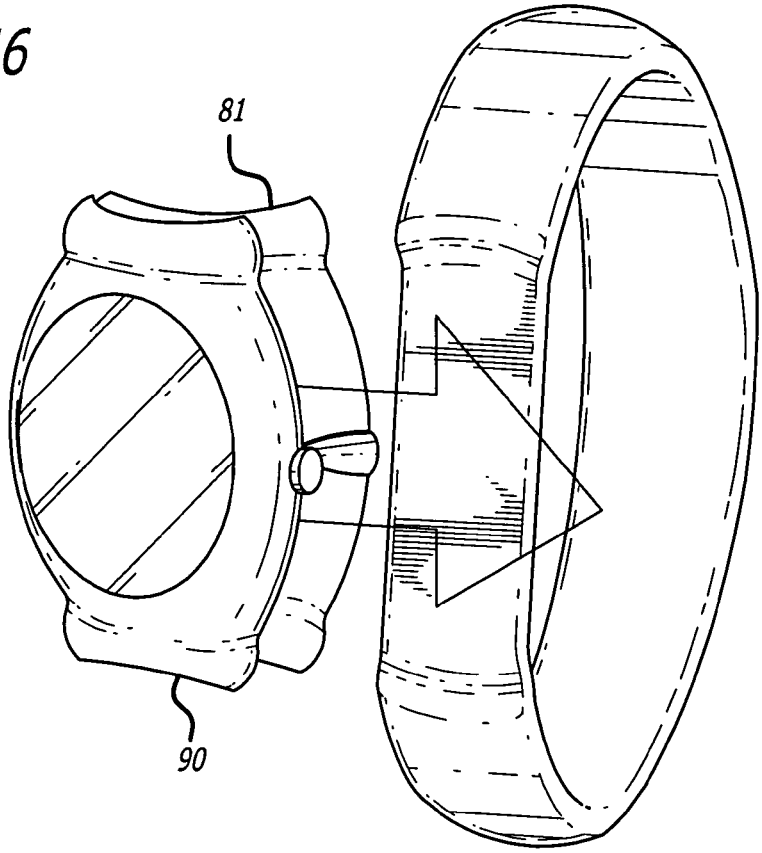
FIGS. 46 and 47 show exemplary uses of the hinging assembly.
Figure 47:
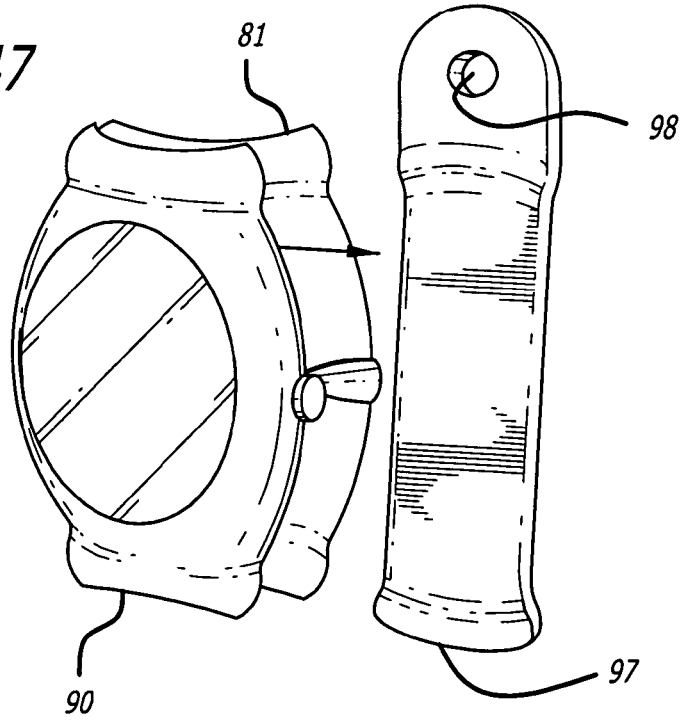

FIGS. 46 and 47, show other uses of the hinging assembly (89), where the overall shape of the watch band is different from the shape of the watch band (96) of FIG. 45 or where supports different from a watch band are used, such as the support (97) of FIG. 47. The support (97) also shows an upper hollow region (98) to allow the support to be attached to other items. The portion of support (97) hosted in the hinging assembly may have other shapes, in particular a substantially circular oval shape matching the shape of the region (95) in the watchcase and/or region (203) in the base element.

The person skilled in the art will understand, upon reading of the present disclosure, that the base element (81) of FIGS. 43-45 can be replaced by the leaf spring element exemplarily shown in FIGS. 33-37. On the other hand, the person skilled in the art will also understand, upon reading of the present disclosure, that the leaf spring element, such as the leaf spring element of FIG. 27, can be replaced by the base element (81) exemplarily shown in FIG. 43-45.

Both the hinge mechanism used to hingedly connect the elements of the hinging assembly of the disclosure and the locking mechanism used to secure the elements of the hinging assembly of the disclosure are known as such to the person skilled in the art and will not be described in detail.

6. System and Method to Teach How to Tell Time

The present disclosure also provides a watch system and method to teach a user how to tell the time, particularly useful for users having difficulties in learning the concept of time, such as children and persons with learning disabilities.

The watch system includes a first display showing the time in an analog or digital manner and a second display showing indication of an event associated with the time shown by the first display. The configuration and dimensions of the first and second display may vary and differ in complexity. The system may also emit sounds accompanied with the indications shown by means of a sound-emitting assembly.

Figure 48:
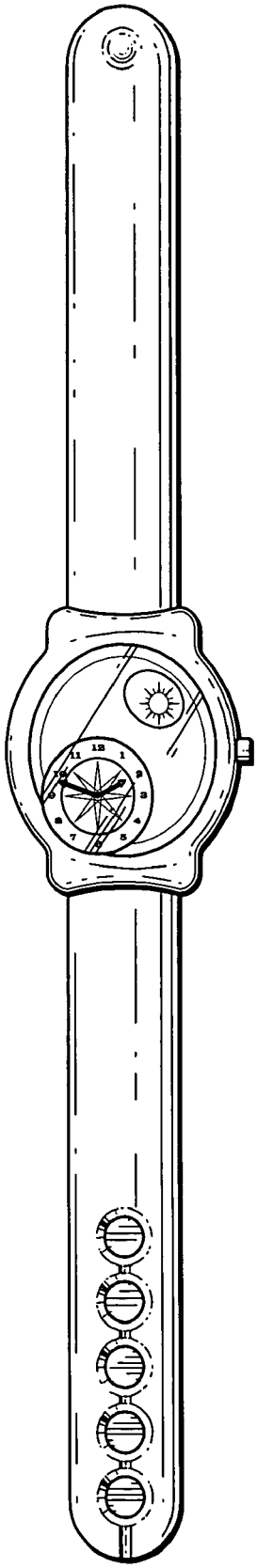
FIGS. 48 and 49 show a "first level" system to teach how to tell time.
Figure 49:
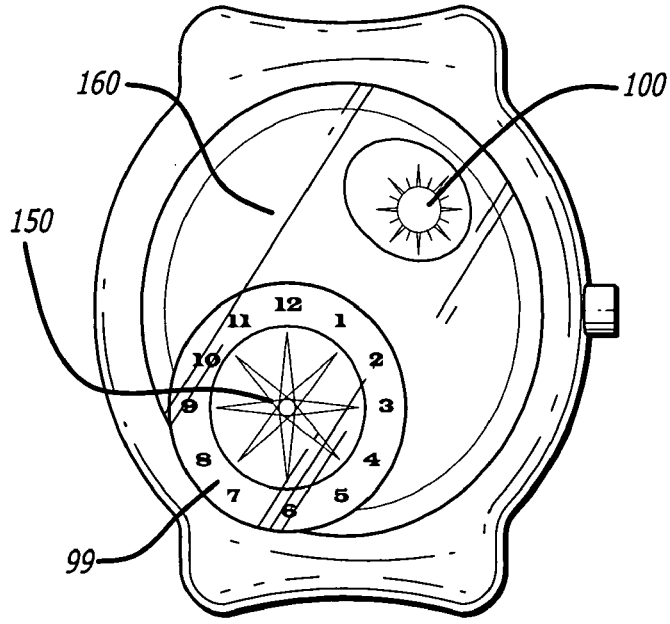

FIG. 48 and the enlarged portion of FIG. 48 shown in FIG. 49 show a "first level" system where the first display (99)

shows a plurality of hour hands (150) and the second display (100) shows a picture or icon that relates to a specific time of day, e.g., sun rising, snack time, nap time, play time, bed time, moon. The picture or icon shown on the second display (100) relates to events in a child's day that are events/milestones in the child's day, thus helping the child to grasp time by tying it to such events/milestones. Preferably, the system is assembled according to one of the embodiments previously discussed. When the second display (100) shows a specific icon, such as a sun rising, the other icons not shown on the display (100) may either be hidden from or visible to the user. In case the other icons are hidden from the user, an opaque cover 160 may be provided. In case the other icons are not hidden from the user, a cover (160) is not necessary, or if provided, it may be transparent.

Figure 50:
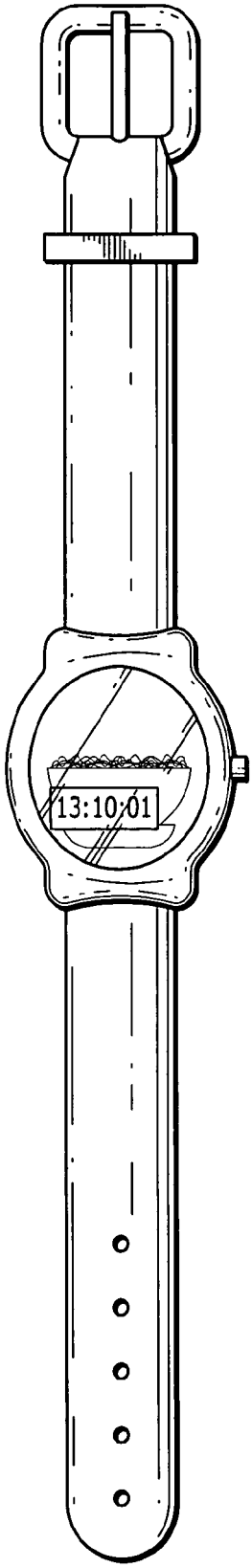
FIGS. 50 and 51 show a "second level" system to teach how to tell time.
Figure 51:
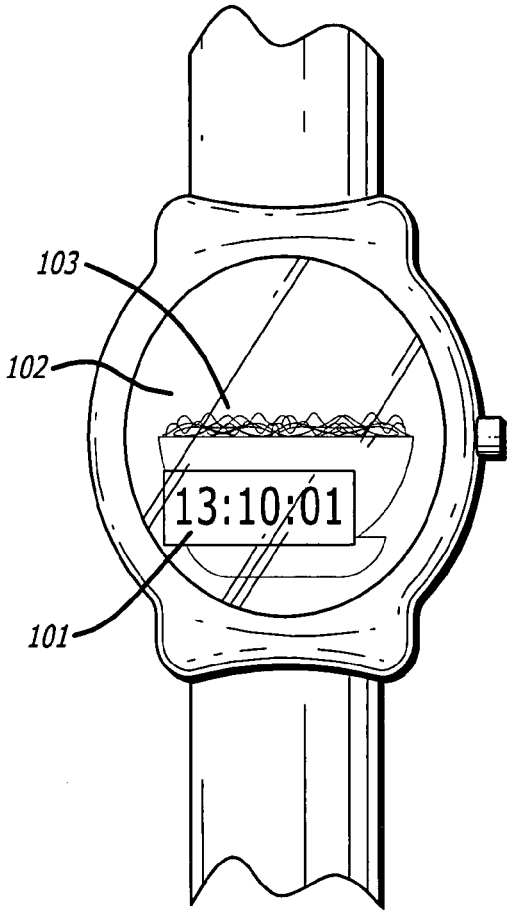

FIG. 50 and the enlarged portion of FIG. 50 shown in FIG. 51 show a "second level" system where also minutes and seconds are shown in one of the displays, for example a digital display such as display (101) of FIG. 51. The other display (102) shows an icon (103) thematically associated with the time shown in the display (101).

Figure 52:
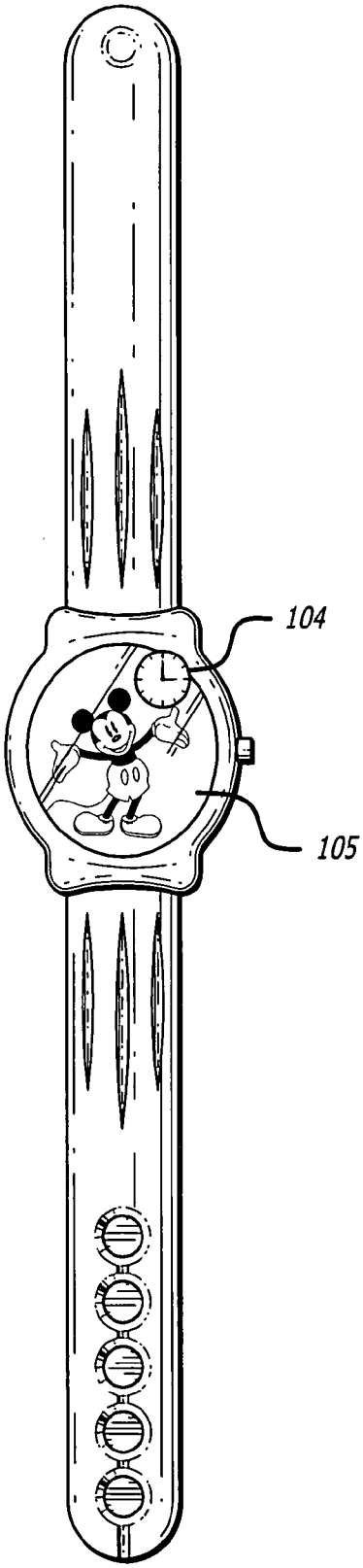
FIGS. 52 and 53 show a third level system to teach how to tell time.
Figure 53A:
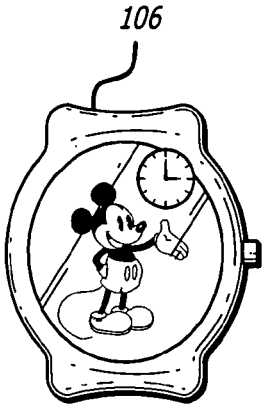
Figure 53B:
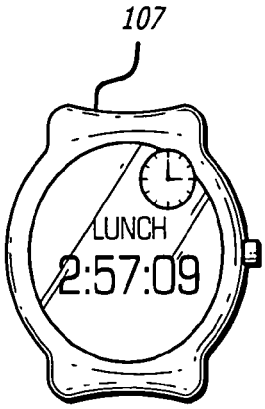
Figure 53C:
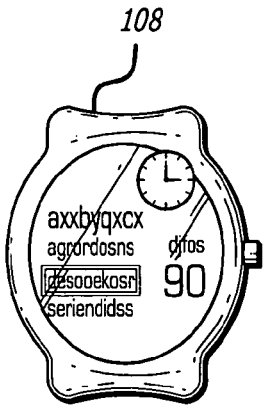
Figure 53D:
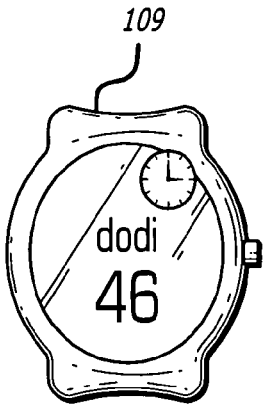
Figure 53E:
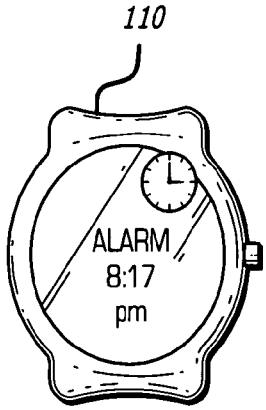

FIG. 52 and the enlarged portion of FIG. 52 shown in FIG. 53 show a "third level" system where one of the displays shows the time, for example in an analog manner as indicated by display (104) and the other display (105) shows an area for different modes that may include information thematically related with the time shown in display (104) and variable according to the skill of the user. The enlarged portions of the system of FIG. 52, shown in FIG. 53, are examples of multiple modes of the area shown in display (105) aiding a child in the learning and incorporating of time into the child's day.

For example, the enlargement (106) shows the area of the display (105) in an animation mode; the enlargement (107) shows the area of display (105) in an activity mode where the watch counts down a major event in a child's day, for example lunch time; in the enlargement (108), the area of display (105) is in a time quiz game mode; in the enlargement (109) the area of display (105) shows, in a digital format, a time relating to the time shown in display (104) in an analog format; and in the enlargement (110) the area of display (105) is in an alarm mode.

Additionally, sounds and animation may also be displayed in all of the embodiments of the system.

The system may be assembled to other items, and in particular to any watch band known in the art, possibly including the snap mechanism according to the present disclosure. The assembly may be made using a technology known in the art and identifiable by the person skilled in the art or by realizing a hinging assembly in accordance with the teachings of the present disclosure.

The relative size of the first and second display can vary. The first display can have a size which is greater than, less than or equal to the size of the second display.

The present disclosure has been explained with reference to specific embodiments. Other embodiments will be apparent to those of ordinary skill in the art in view of the foregoing description. The scope of protection of the present disclosure is defined by the appended claims.

What is claimed is:

1. A snapping mechanism on a strap, the strap comprising recessed regions, the snapping mechanism comprising a magnet assembly and a metal assembly, the metal assembly being connectable with the magnet assembly in a mating fashion, the metal assembly comprising one or more staple elements, each of the one or more staple elements having a mating portion and an engaging portion, the engaging portion comprising a first bendable portion and a second bendable portion, the first and second bendable portion being inserted into the strap in correspondence of the recessed regions.

2. The snapping mechanism of claim 1, wherein each recessed region comprises two slots, the first bendable portion of the staple elements being inserted in one of the two slots, and the second bendable portion of the staple elements being inserted in the other one of the two slots.

3. The snapping mechanism of claim 1, wherein the mating portion is substantially arc-bean-shaped.

4. The snapping mechanism of claim 1, wherein each recessed region comprises two stepped portions and a flat portion between the two stepped portions.

5. The snapping mechanism of claim 4, wherein each recessed region comprises a first slot between one stepped portion and the flat portion and a second slot between the other stepped portion and the flat portion.

6. The snapping mechanism of claim 5, wherein the first bendable portion of the staple elements is inserted into the first slot and the second bendable portion of the staple elements is inserted into the second slot.

* * * * *